US012454833B2

(12) United States Patent
Wolff

(10) Patent No.: US 12,454,833 B2
(45) Date of Patent: Oct. 28, 2025

(54) LAMELLA WALL SYSTEM

(71) Applicant: Rockwool A/S, Hedehusene (DK)

(72) Inventor: Jesper Wolff, Hedehusene (DK)

(73) Assignee: Rockwool A/S, Hedehusene (DK)

( * ) Notice: Subject to any disclaimer, the term of this patent is extended or adjusted under 35 U.S.C. 154(b) by 0 days.

(21) Appl. No.: 18/023,275

(22) PCT Filed: Aug. 27, 2021

(86) PCT No.: PCT/EP2021/073792
§ 371 (c)(1),
(2) Date: Feb. 24, 2023

(87) PCT Pub. No.: WO2022/043523
PCT Pub. Date: Mar. 3, 2022

(65) Prior Publication Data

US 2023/0313538 A1 Oct. 5, 2023

(30) Foreign Application Priority Data

Aug. 28, 2020 (EP) ..... 20193476

(51) Int. Cl.
*E04F 13/08* (2006.01)

(52) U.S. Cl.
CPC ..... *E04F 13/0812* (2013.01); *E04F 13/0819* (2013.01)

(58) Field of Classification Search
CPC ..... E04F 13/0812; E04F 13/0819; E04F 13/0814; E04F 13/083; E04F 13/12
USPC ..... 52/506.01, 506.08, 489.1, 489.2
See application file for complete search history.

(56) References Cited

U.S. PATENT DOCUMENTS 2,041,773 A * 5/1936 Manske ..... E04F 13/045 52/285.3
2,490,663 A * 12/1949 Van Uum ..... E04F 13/0848 52/459
2,664,978 A * 1/1954 Fox ..... E04F 13/0803 52/552
2,665,780 A * 1/1954 Hammitt ..... E04D 3/3605 52/489.1
3,209,505 A * 10/1965 Vermeulen ..... E04F 13/0812 52/506.08

(Continued)

FOREIGN PATENT DOCUMENTS

AU 2018282353 A1 7/2019
CN 101473096 A 7/2009

(Continued)

*Primary Examiner* — James M Ference
(74) *Attorney, Agent, or Firm* — Dinsmore & Shohl LLP

(57) ABSTRACT

A lamella fixing system includes: at least one supporting profile; at least one lamella comprising a groove; and at least one connector clip for interconnecting the lamella and the supporting profile, wherein the connector clip is made of a steel sheet includes a planar, longitudinal part, at least one rearward folded part for attachment to the supporting profile, and at least one forward folded part for attachment to the lamella groove. The supporting profile is provided with a depression or an opening, such as a slit, in a front flange, and the connector clip is provided with at least one further rearward folded part configured to engage with the depression or opening, such as a slit, of the supporting profile.

18 Claims, 14 Drawing Sheets

(56) References Cited

U.S. PATENT DOCUMENTS 3,248,839 A * 5/1966 Roberts ..... E04B 9/10 52/506.07
3,295,284 A * 1/1967 Tschiesche ..... E04F 13/0812 52/506.07
3,300,926 A * 1/1967 Heirich ..... E04F 13/0812 52/798.1
3,313,075 A * 4/1967 Buchmeier ..... E04F 13/0803 52/144
3,343,309 A * 9/1967 Netz ..... F21V 21/02 52/28
3,357,148 A * 12/1967 Turner ..... E04F 13/0814 52/489.1
3,612,461 A * 10/1971 Brown ..... E04B 9/18 52/506.07
3,678,641 A * 7/1972 Englund ..... E04B 9/26 52/506.08
3,803,790 A * 4/1974 Buck ..... E04D 3/36 52/473
3,815,309 A * 6/1974 Olsen ..... E04F 13/0812 52/235
3,871,150 A * 3/1975 Murray ..... E04B 9/16 52/779
4,041,668 A * 8/1977 Jahn ..... E04B 9/16 52/506.09
4,157,000 A * 6/1979 Sutter ..... E04B 9/24 52/506.07
4,245,446 A * 1/1981 Judkins ..... E04B 9/26 52/506.08
4,261,153 A * 4/1981 Haines, Jr. ..... G09F 15/0012 52/712
4,272,937 A * 6/1981 Brugman ..... E04B 9/363 52/506.07
4,309,858 A * 1/1982 Anderle ..... E04B 9/26 52/645
4,395,858 A * 8/1983 Gwyther ..... E04F 13/0814 52/509
4,400,922 A * 8/1983 Boyer ..... E04D 3/3607 52/529
4,520,607 A * 6/1985 Suckow ..... E04B 9/26 24/336
4,635,424 A * 1/1987 Drapeau ..... E04F 13/0812 52/510
4,884,383 A * 12/1989 Rijnders ..... E04B 9/26 52/506.07
5,590,502 A * 1/1997 Wendt ..... E04B 2/7457 52/489.1
5,822,941 A * 10/1998 Kinsella ..... E04B 9/28 52/712
6,324,808 B1 * 12/2001 Lippy ..... E04B 9/26 52/712
8,857,121 B2 * 10/2014 Baxter ..... E04B 9/363 52/506.08
9,926,707 B1 * 3/2018 Knight, Jr. ..... E04F 13/0891
10,640,988 B2 * 5/2020 Bitsch ..... E04F 13/0814
2013/0047541 A1 * 2/2013 Mayer ..... E04B 9/065 52/506.05
2013/0183088 A1 * 7/2013 Wilkinson, Jr. ..... F16B 3/00 403/354
2013/0192772 A1 * 8/2013 Damen ..... E06B 9/00 160/405
2015/0040506 A1 * 2/2015 Baxter ..... E04B 9/26 52/741.1
2019/0186134 A1 * 6/2019 Langeveld ..... E04F 13/083
2020/0080317 A1 * 3/2020 Girnghuber ..... E04F 13/0819
2022/0106796 A1 * 4/2022 Houfflyn ..... E04F 13/12
2023/0313538 A1 * 10/2023 Wolff ..... E04F 13/0819 52/506.01

FOREIGN PATENT DOCUMENTS

CN 104334810 A 2/2015
GB 1064521 4/1967
GB 1065710 A 4/1967
RU 2270303 C1 2/2006

* cited by examiner

LAMELLA WALL SYSTEM

CROSS-REFERENCE TO RELATED APPLICATIONS

This application is the U.S. National Stage of PCT/EP2021/073792 filed on Aug. 27, 2021, which claims priority to European Patent Application 20193476.7 filed on Aug. 28, 2020, the entire content of both are incorporated herein by reference in their entirety.

FIELD OF THE INVENTION

The present invention relates to a lamella fixing system, and a method of installing a lamella.

BACKGROUND OF THE INVENTION

Building walls may be clad, or covered, by an array of spaced apart lamellae, where a lamella is a longitudinal element of e.g. metal, plastic, composite, or a wood based material, such as wood veneered aluminum or wood fibers on composite. A lamella is also referred to as a rib or a batten, and any building wall or surface may be clad by the lamellae, including external and internal walls, dividers, ceilings, and floors. Lamella linings, or lamella walls, are known to provide walls with a particular decorative and aesthetic appeal, as well as walls providing particular acoustic damping.

For installation of the lamella wall, the lamellae are typically fixed to the supporting wall behind, by a fixing system. AU2018282353 [1] discloses a fixing system comprising a base track and a diecast clip with two profiles: a first profile which can be attached to the base track, and a second profile which the batten may subsequently be attached to. The batten is attached to the second profile of the clip by use of a retainer element in the form of a spring wire or a wedge, which enables fastening of the batten to the clip.

The installation of a lamella wall including the fixing system, is typically complex, time consuming, and may require use of force fixing tools. Hence, improved simplicity and efficiency of the installation, e.g. installation with a reduced need for additional tools, are desirable.

SUMMARY OF THE INVENTION

The present disclosure provides a lamella fixing system including a connector clip, which is simpler to manufacture and simpler to install, particularly without the use of additional tools. Hence, the present disclosure provides a simpler, more efficient and reliably installed lamella wall system.

The advantages are obtained by use of a connector clip for interconnecting the lamella and the supporting profile. The connector clip comprises, or preferably is made of a steel sheet comprising a planar, longitudinal part, at least one rearward folded part for attachment to the supporting profile, and at least one forward folded part for attachment to a groove within the lamella. Hence, advantageously, the connector clip may be manufactured from a cut, one piece sheet by simple bending into a three dimensional shape, where the shape is configured for attachment to the supporting profile and the lamella. Particularly, the at least one forward folded part may be configured to be elastically compressed in the width direction, thereby forming an elastically stressed configuration facilitating easy, simple and robust detachably attachment of the lamella to the connector clip.

A first aspect of the invention relates to a lamella fixing system, comprising:

- at least one supporting profile,
- at least one lamella comprising a groove, and
- at least one connector clip for interconnecting the lamella and the supporting profile,
- wherein the connector clip is made of a steel sheet comprising a planar, longitudinal part, at least one rearward folded part for attachment to the supporting profile, and at least one forward folded part for attachment to the lamella groove.

Advantageously, the first aspect relates to a lamella fixing system, comprising:

- at least one supporting profile,
- at least one lamella comprising a groove, and
- at least one connector clip for interconnecting the lamella and the supporting profile,
- wherein the connector clip is made of a steel sheet comprising a planar, longitudinal part, at least one rearward folded part for attachment to the supporting profile, and at least one forward folded part for attachment to the lamella groove,
- wherein the supporting profile is provided with a depression or an opening, such as a slit, in a front flange, and
- the connector clip is provided with at least one further rearward folded part configured to engage with the depression or opening, such as a slit, of the supporting profile.

Hence, in accordance with the invention the connector clip advantageously furthermore includes at least one further rearward folded part with a spring function between a folded and less folded configuration.

A second aspect of the invention relates to a method of installing a lamella, comprising the steps of:

(a) providing a lamella fixing system comprising at least a supporting profile, a lamella comprising a groove, and a connector clip made of a steel sheet, comprising a planar, longitudinal part, at least one rearward folded part, and at least one forward folded part, (b) attaching the rearward folded part of the connector clip to the supporting profile, (c) slidingly attaching the lamella groove to the forward folded part of the connector clip by force, thereby elastically compressing the forward folded part in a direction perpendicular to the longitudinal direction.

In a preferred embodiment of the second aspect, the lamella fixing system is the system according to the first aspect. Hence, advantageously the second aspect relates to a method of installing a lamella, comprising the steps of:

(a) providing a lamella fixing system according to the first aspect, (b) attaching the rearward folded part of the connector clip to the supporting profile, (c) slidingly attaching the lamella groove to the forward folded part of the connector clip by force, thereby elastically compressing the forward folded part in a direction perpendicular to the longitudinal direction

BRIEF DESCRIPTION OF DRAWINGS

The invention will in the following be described in greater detail with reference to the accompanying drawings.

DETAILED DESCRIPTION OF THE INVENTION

Figure 1:
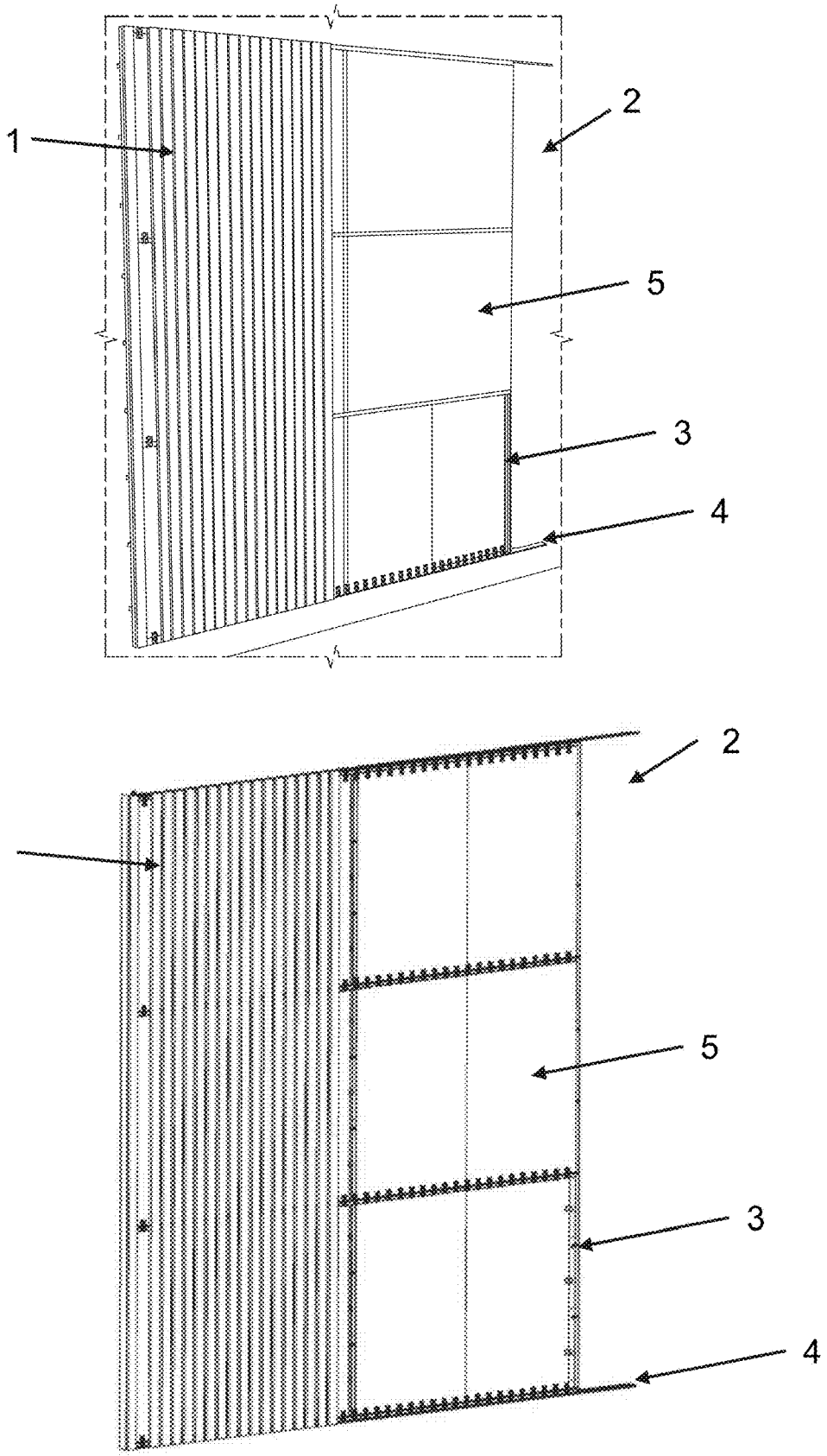
FIG. 1 shows an embodiment of a lamella wall according to the present disclosure in perspective view (upper figure), and line drawing (lower figure)

The invention is described below with the help of the accompanying figures. It would be appreciated by the people skilled in the art that the same feature or component of the device are referred with the same reference numeral in different figures. A list of the reference numbers can be found at the end of the detailed description section.

Lamella Fixing System

FIG. 1 shows an embodiment of a lamella wall, where multiple lamellae 1 are fixed to a supporting wall 2 behind, by a fixing system according to the present disclosure. The fixing system comprises connector clips 6 interconnecting each lamella to a supporting profile 4, where the supporting profile may be fixed directly onto the wall surface, or alternatively mounted onto wall profiles 3 fixed to the wall. FIG. 1 shows an embodiment of the fixing system comprising horizontally oriented supporting profiles 4, mounted onto vertically oriented wall profiles 3.

From FIG. 1 it is further seen that the lamellae are covering the wall surface behind, and the side of the lamellae facing the viewer or room, is also referred to as the front side or forward side, and the side of the lamellae facing the wall behind is also referred to as the rear side/backward side.

Figure 2:
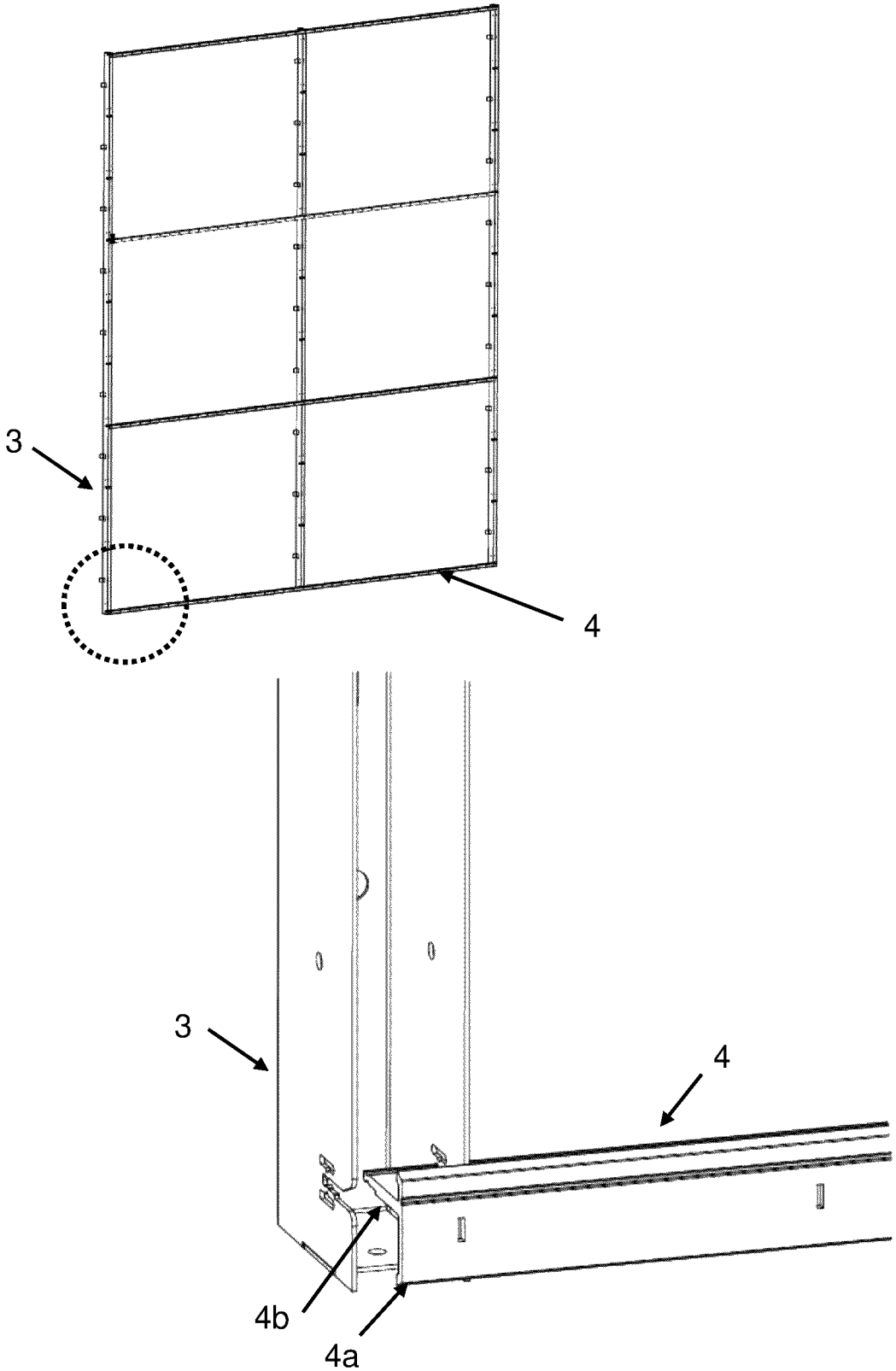
FIG. 2 shows an embodiment of the installation of the supporting profiles according to the present disclosure.
Figure 17A:
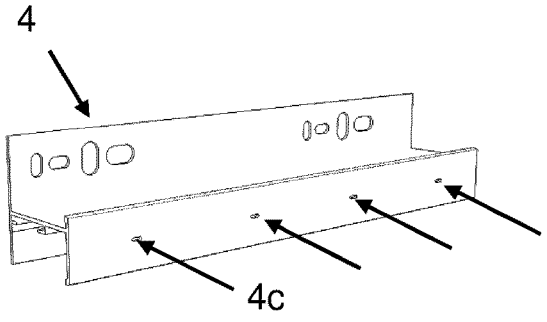
FIGS. 17A-17C depict embodiments of the supporting profile according to the present disclosure, which is asymmetric U-shaped as shown in FIG. 17B, or H-shaped shown in FIGS. 17A and 17C, when viewed in cross-section.
Figure 17B:
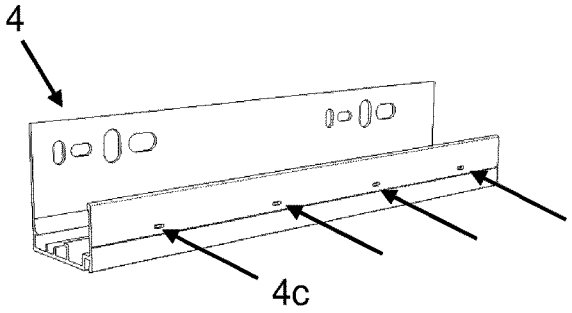

FIG. 2, the inserted detailed figure, shows an embodiment of the installation of the supporting profiles 4 according to the present disclosure, when the supporting profiles are mounted to a wall profile 3. Advantageously, the supporting profile comprises a front flange 4*a* extending parallel to the wall surface, and at least one fastening element 4*b* for attachment to the supporting wall. Advantageously, the fastening element is in the form of a wall mounting flange, e.g. a rearward extending flange as shown in FIG. 2, extending perpendicular to the front flange, such that the supporting profile is T-shaped or asymmetric T-shaped as seen in cross-section. The supporting profile may thus be simple, easy, and manually installed, by slidingly inserting the rearward extending flange into a slit of the wall profile, as illustrated in the insert of FIG. 2. For further stable installation, the rearward extending flange and the wall profile slit may be configured to form a form-fit or snap-fit attachment upon complete insertion/receival of the flange, such that complete insertion/receival is audible, e.g. by a click, or easily visibly seen. Alternatively, or additionally, the supporting profile may comprise a rear flange extending in parallel with the front flange, such that it has a H-shape or U-shape, or asymmetric H-shape or U-shape, as seen in cross-section or profile. Examples of a profile with an asymmetric H-shape and U-shape is illustrated in respectively FIGS. 17A and 17B. This has the advantage that the rear flange may be mounted directly to a wall surface by fastening means, such as nails, screws, bolts, and/or dowels.

Figure 3:
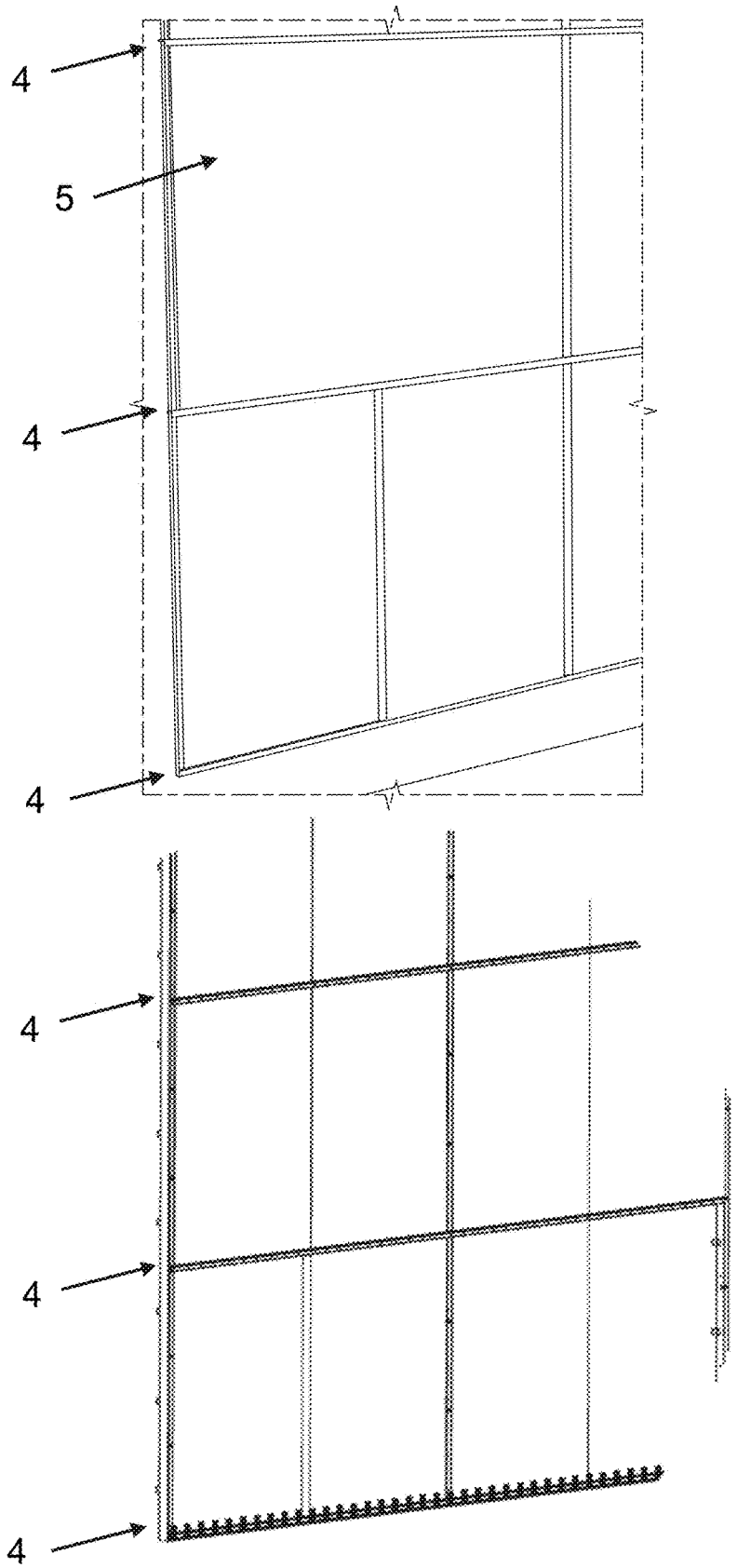
FIG. 3 shows an embodiment of the mounted supporting profiles according to the present disclosure, where the wall comprises acoustic panels, in perspective view (upper figure), and line drawing (lower figure)

In an embodiment of the disclosure, the supporting profile comprises a front flange in parallel to the wall surface, and at least one fastening element for attachment to a supporting wall. In a further embodiment, the fastening element is a rearward flange extending perpendicular to the front flange, such that the supporting profile is T-shaped or asymmetric T-shaped in cross-section. In a further embodiment, the supporting profile comprises a rear flange in parallel with the front flange, such that the supporting profile is H-shaped or U-shaped in cross-section The asymmetric T-shaped, U- or H-shaped supporting profile further has the advantage of facilitating the installation of acoustic panels. Acoustic panels are slab shaped elements placed between the supporting wall and the lamellae, which provide additional acoustic damping/improvement, and which may further be decorative, since the front side of the panel will be visible between neighbouring lamellae. FIGS. 1 and 3 show embodiments of lamella walls, comprising acoustic panels 5. An example of an acoustic panel is a stone wool slab, optionally provided with a coloured fleece on the front surface.

Figure 17C:
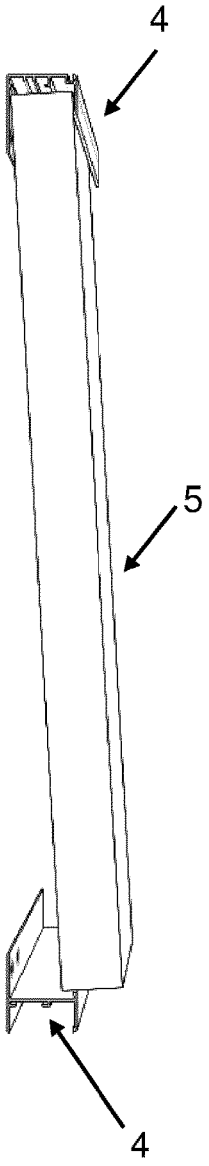

The acoustic panel 5 is installed between two neighbouring supporting profiles, e.g. the upper and middle supporting profiles 4 shown in FIG. 3. Both the upper supporting profile and the middle supporting profile have an asymmetric T-shape in cross-section, and are oriented in the same direction as shown in FIG. 2, such that the front flange 4*a* has a lower front part and an upper front part separated by the fastening element, where the lower part is vertically longer than the upper part. The dimensions of the acoustic panel is configured such that the panel may be simply and manually mounted between the neighbouring supporting profiles by first arranging the upper edge of the acoustic panel behind the lower part of the front flange of the upper supporting profile, and then the lower edge of the acoustic panel may be moved above the upper part of the front flange of the lower supporting profile, and then slid down or dropped down behind the upper part of the front flange of the lower supporting profile, such that the lower edge of the panel is abutting the rearward extending flange of the lower supporting profile. The dimensions of the acoustic panels further ensure that the panel is fixed in parallel to the wall behind by the front flanges of the lower and upper supporting profiles. The installation of an acoustic panel 5 is also shown in FIG. 17, where the supporting profiles comprises a rear flange in parallel with, and mounted on a wall surface, and where the upper supporting profile has an asymmetric U-shape in cross-section, and the lower supporting profile has an asymmetric H-shape. The panel is simply and manually mounted between the upper and lower supporting profiles by first arranging the upper edge of the acoustic panel behind the lower part of the front flange of the upper supporting profile (indicated by the upper arrow in FIG. 17C), and then the lower edge of the acoustic panel may be moved above the upper part of the front flange of the lower supporting profile (indicated by the lower arrow in FIG. 17C), and then slid down or dropped down behind the upper part of the front flange of the lower supporting profile, such that the lower edge of the panel is abutting the rearward extending flange of the lower supporting profile.

It follows that the lamella fixing system advantageously comprises at least three parts: at least one supporting profile, at least one lamella, and at least one connector clip for interconnecting the lamella and the supporting profile. However, a connector clip may alternatively be adapted for attachment directly onto a wall surface, or adapted for fastening to the wall surface by other means than a supporting profile, e.g. by use of nails, screws, or glue.

Hence, a preferred embodiment of the disclosure relates to a lamella fixing system, comprising:

at least one supporting profile, at least one lamella comprising a groove, and at least one connector clip for interconnecting the lamella and a supporting wall, wherein the connector clip is made of a steel sheet comprising a planar, longitudinal part, at least one rearward folded part for attachment to a supporting wall, and at least one forward folded parts for attachment to the lamella groove.

Connector Clip

Figure 4:
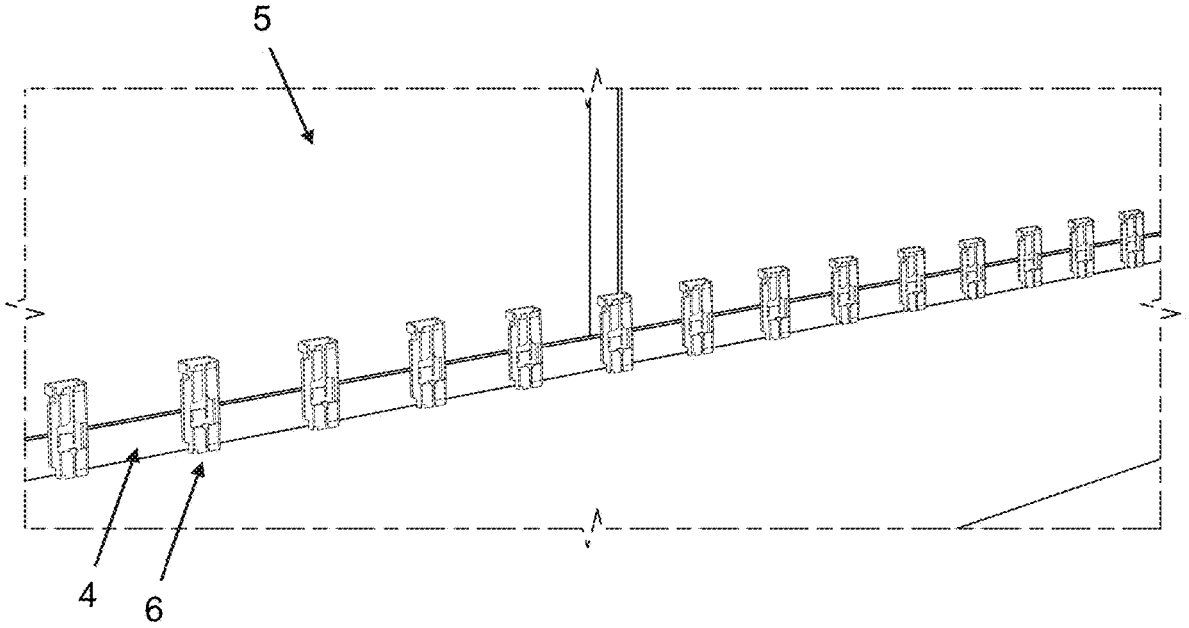
FIG. 4 shows an embodiment of the connector clip according to the present disclosure, attached to a supporting profile, as viewed from the front side of the wall, in perspective view (upper figure), and line drawing (lower figure)
Figure 4:
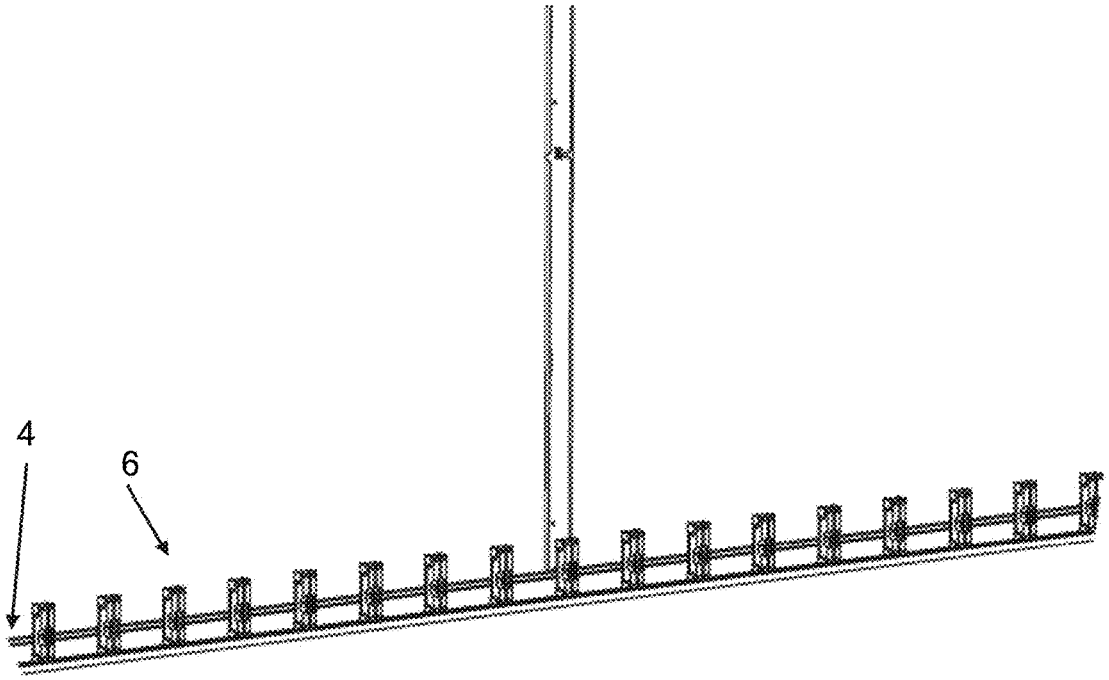
Figure 5:
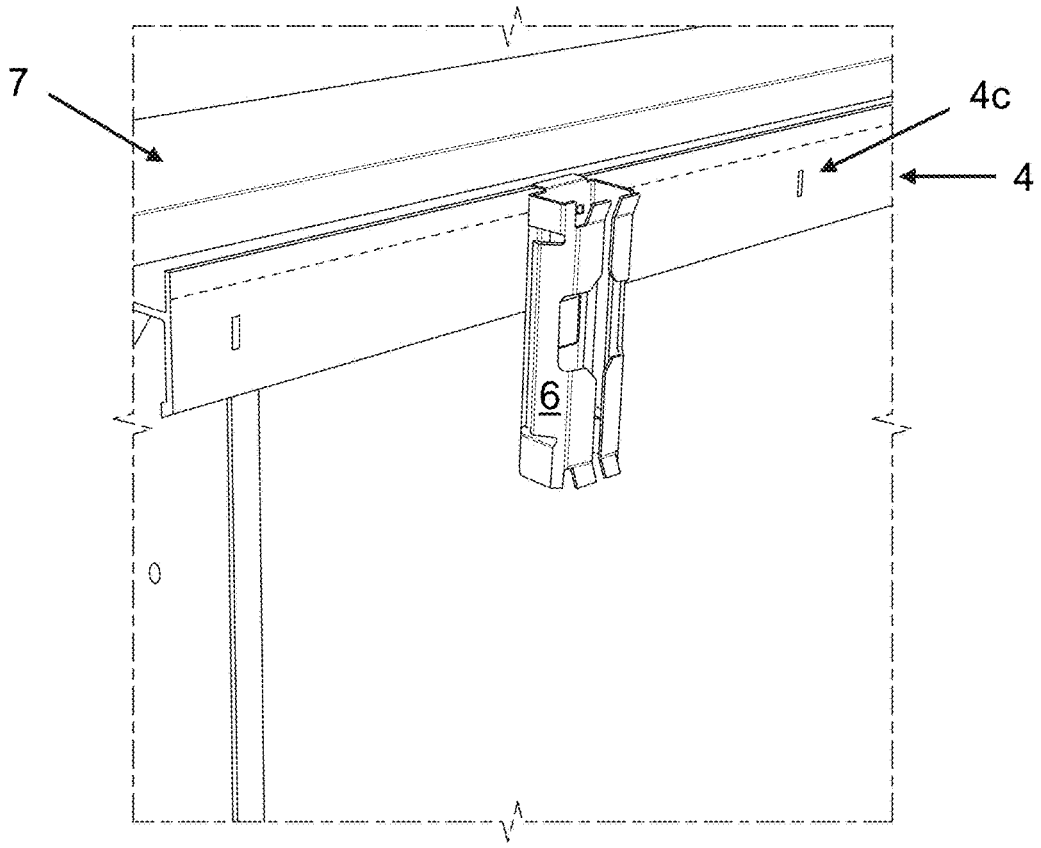
FIG. 5 shows an embodiment of the connector clip according to the present disclosure, attached to a supporting profile, as viewed from the front side of the wall, in perspective view (upper figure), and line drawing (lower figure)
Figure 5:
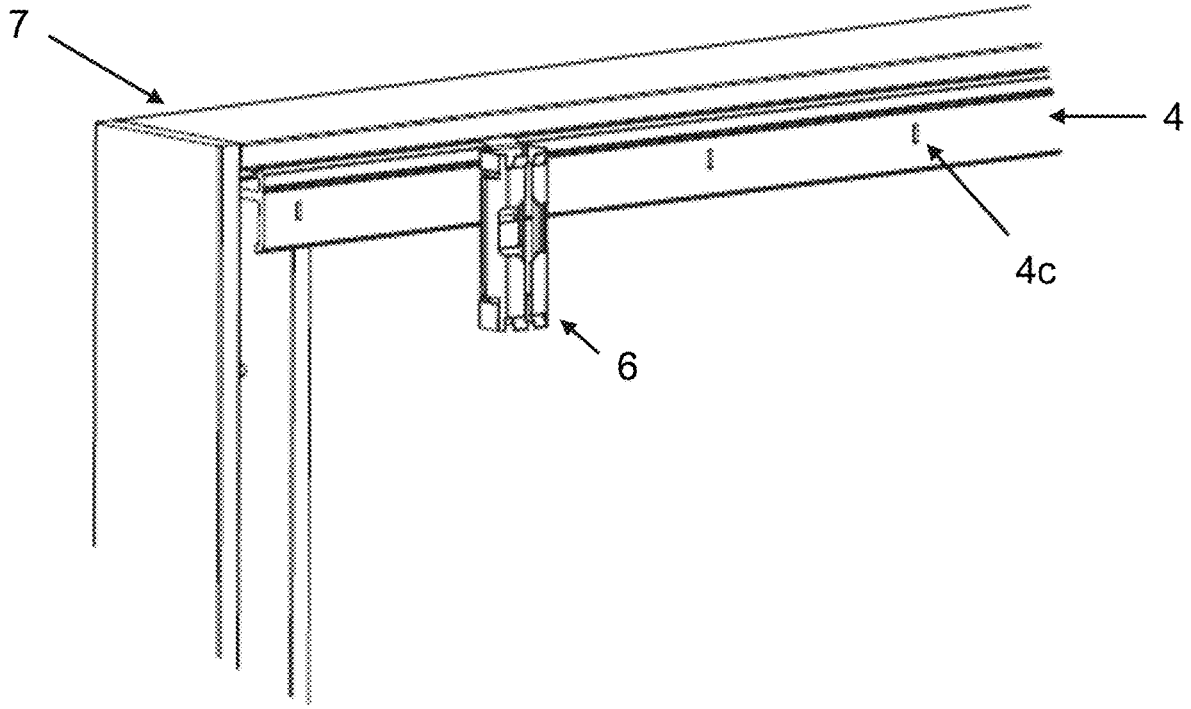
Figure 6:
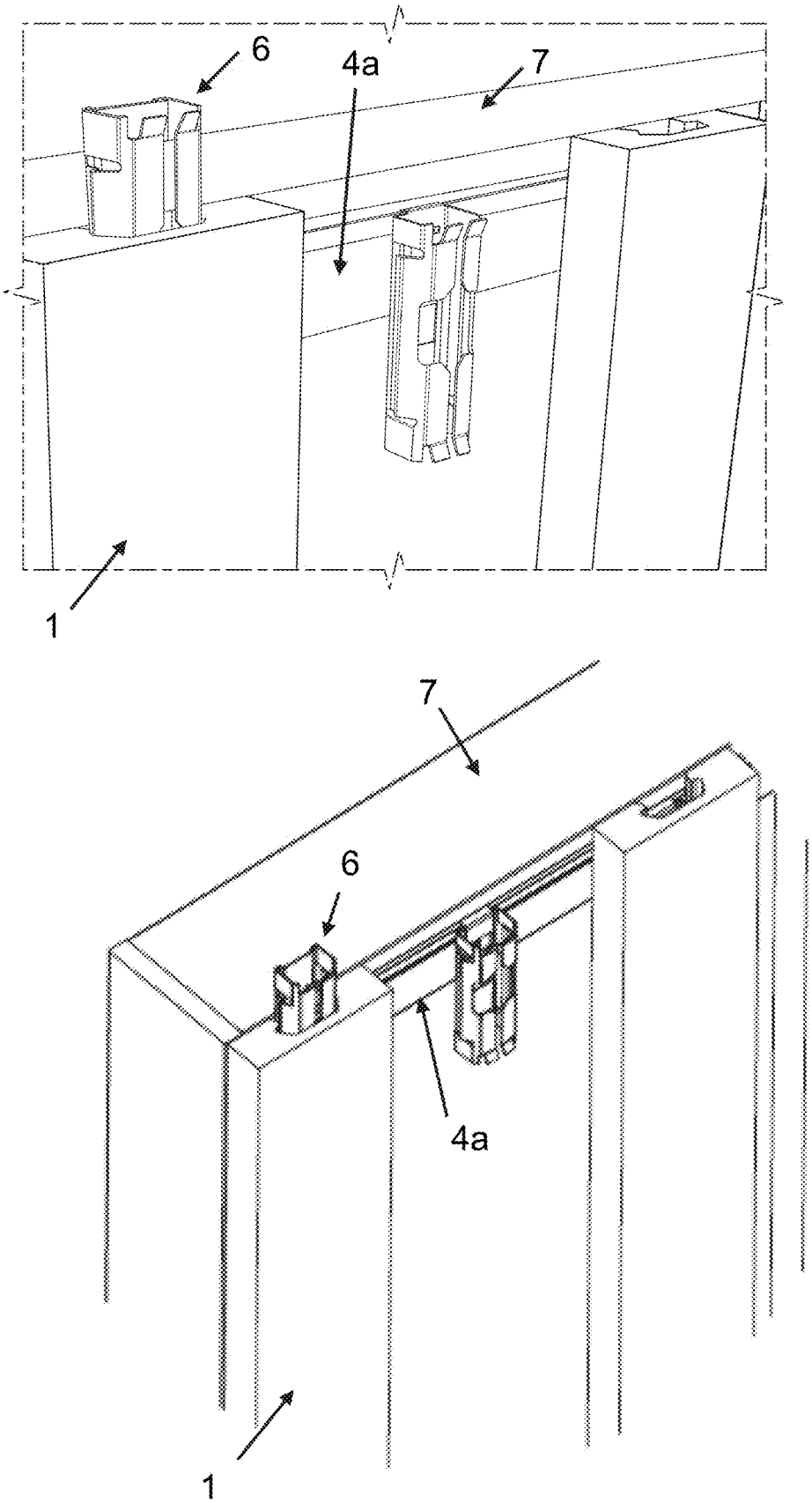
FIG. 6 shows an embodiment of the connector clip according to the present disclosure, attached to a supporting profile and a lamella, as viewed from the front side of the wall, in perspective view (upper figure), and line drawing (lower figure)

FIGS. 4-5 show embodiments of the lamella fixing system and the connector clip 6, where the clip 6 is attached to a supporting profile 4, as viewed from the front side of the wall. Specifically, FIG. 5 shows a corner assembly without lamellae (from the front side). The first/last lamella will eventually cover the assembly, the vertical rail/wall support and edge of the absorbent/acoustic panel. FIG. 6 shows an embodiment of the connector clip 6 attached to both a supporting profile 4 and a lamella 1, as seen from the front side of the wall. As most clearly seen in FIG. 6, the connector clip 6 comprises a planar, longitudinal part partially abutting the front flange of the supporting profile 4, and then the rearward side of the clip 6 engages with the supporting profile 4, and the front/forward side of the clip engages with the lamella groove.

Specifically, the rearward side of the clip 6 engages with the supporting profile 4 via at least one gripping flange or gripping finger, which is folded over the upper edge of the front flange 4*a* of the supporting profile 4, as indicated in FIG. 6. The gripping flange has the advantage that the clip may be detachably attached to the supporting profile 4, and hence easily mounted or dismounted by manual force. In addition or alternatively, the clip may be detachably attached to the supporting profile, such that the clip is dismounted from the supporting profile by use of a tool. The tool may be configured such that the shape of the clip is easily maintained and/or restored upon dismounting.

Figure 15:
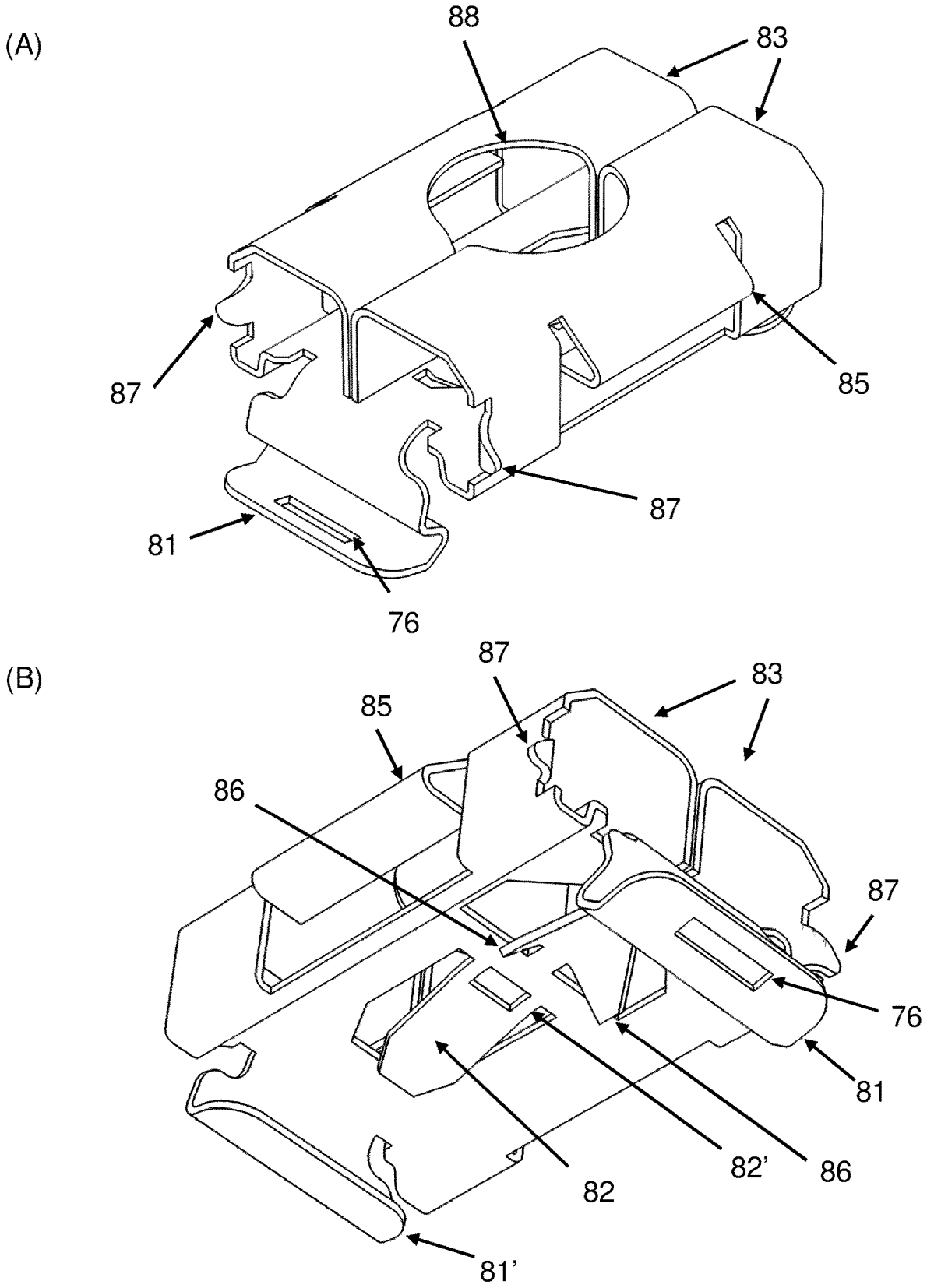
FIG. 15 shows another embodiment of the connector clip according to the present disclosure, where (A) shows the clip as seen from the front side in perspective view, and (B) shows the clip as seen from the rear side in perspective view.
Figure 16A:
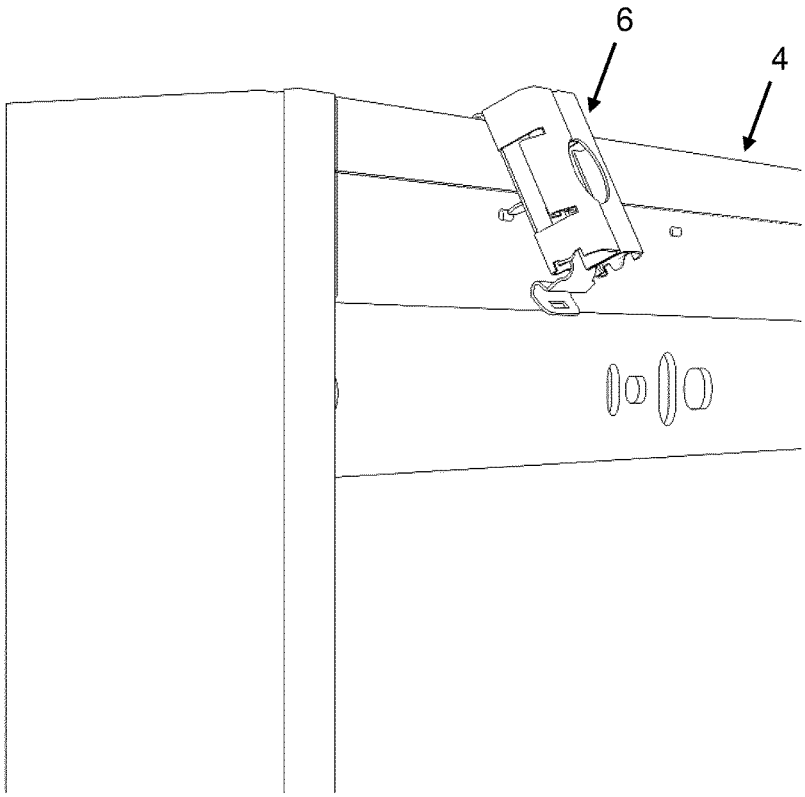
FIG. 16 shows an embodiment of the connector clip according to the present disclosure being attached to a supporting profile, and a lamella being attached to the connector clip.
Figure 16B:
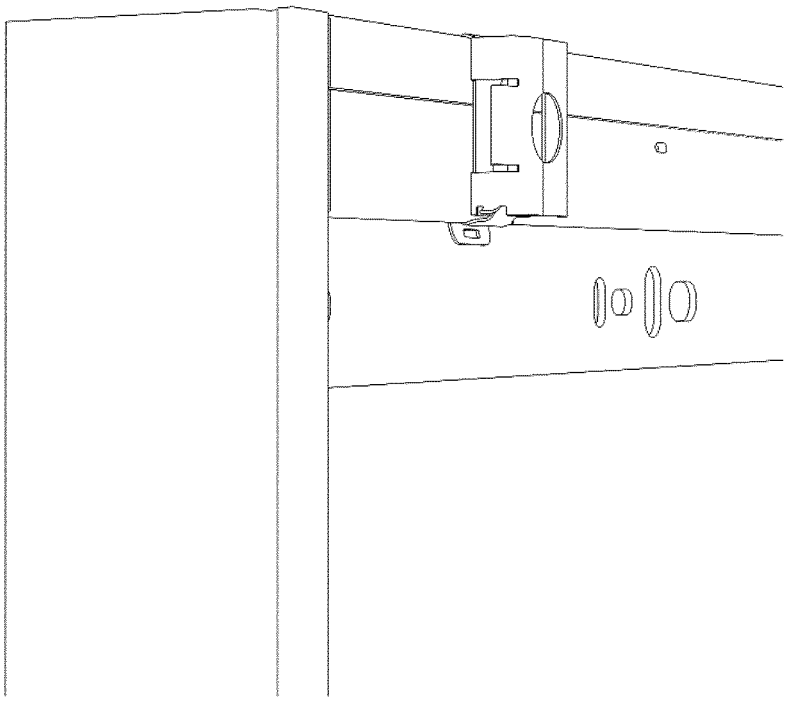
Figure 16C:
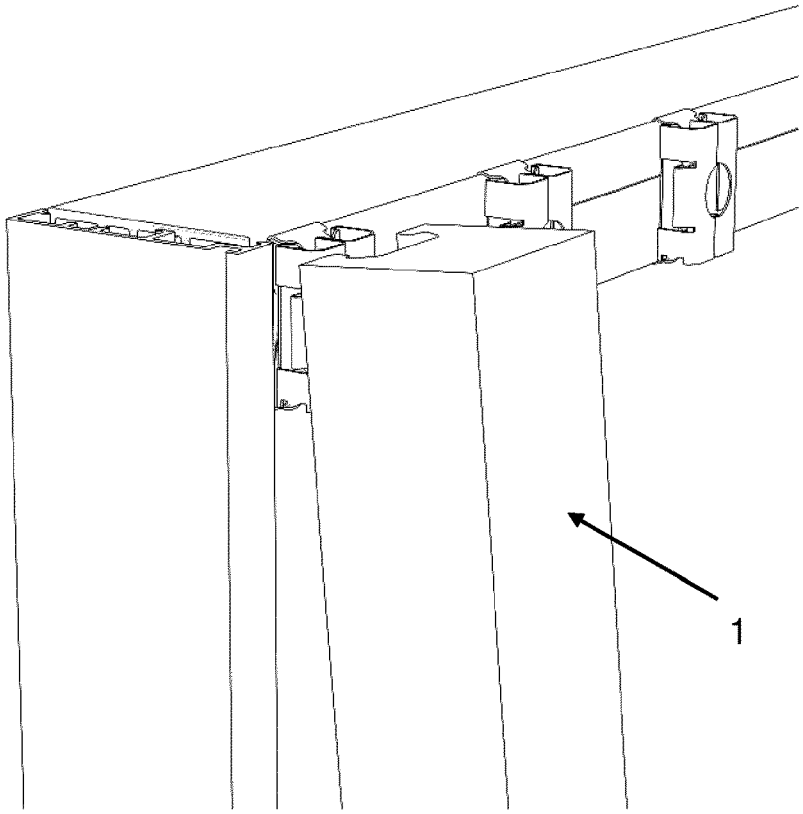
Figure 16D:
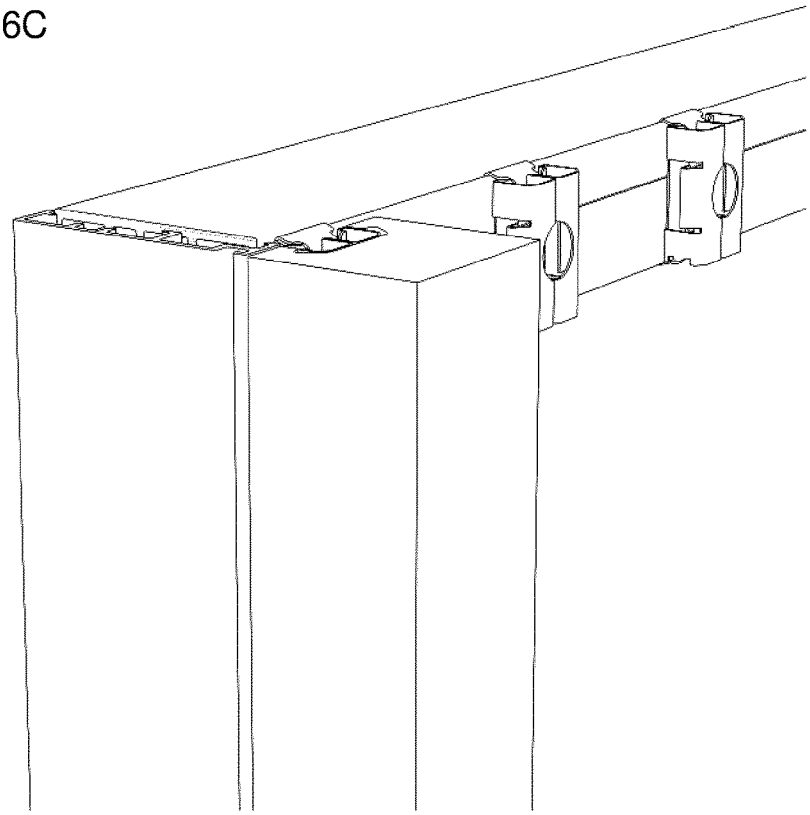

The front side of the clip 6 engages with the lamella groove via a compressive front flange having a width which is larger than the opening width of the lamella groove. For example, the compressive flange may comprise two compressive flanges 65, 75 separated by a gap as shown in FIGS. 6 and 8-12. Alternatively, the two compressive flanges 85 may have a folded portion abutting each other, as shown in FIG. 15. Due to the width, the compressive flange(s) 65, 75 are adapted to form a spring force connection to the lamella groove. This means that the compressive flange(s) 65, 75, 85 exert a pressure on the lamella groove, thereby fixing the lamella to the clip. The spring force connection may be obtained by elastic compression and deformation of the compressive flange 65, 75, 85 upon inserting the flange into to the groove. The compressed flanges form an elastically stressed configuration, exerting a force towards the lamella groove as the flanges try to recoil to the non-stressed configuration. For example, as shown in FIGS. 6 and 8-12, the two compressive flanges 65, 75 may be elastically compressed in the width direction such that the gap between them is reduced, i.e. the flanges are compressed in a direction perpendicular to the longitudinal direction of the clip, when inserted into the groove. It follows that a similar effect may be obtained with a single compressive flange with a comparable width as the two compressive flanges 65, 75. Alternatively, the two compressive flanges 85 are abutting along a folded portion, as shown in FIG. 15, and only the part of the flanges in the width direction, which is in contact with the groove edges are compressed in the width direction or the direction perpendicular to the longitudinal direction of the clip, when inserted into the lamella groove.

In an embodiment of the disclosure, the at least two forward folded parts are configured such that a folded portion is abutting each other.

Further advantageously, the at least one forward folded part includes an inclined plane at the edge of the width, where the plane has an inclination below 90 degrees relative to the planar, longitudinal part, as seen in FIG. 6 or FIG. 15. Thus, the edge of the forward folded part may form a barbed engagement to the lamella groove in the width direction, and facilitate a more smooth insertion of the clip into the lamella groove.

The spring force connection between the lamella and the clip, as well as the inclined edge of the connector clip width, facilitate that the lamella may be detachably attached to the connector clip, and easily mounted by forcing the lamella against the clip using manual force.

In an embodiment of the disclosure, the connector clip, and hence the lamella fixing system, comprises at least one forward folded part configured to be elastically compressed in the width direction, thereby forming an elastically stressed configuration. In a further embodiment, the at least one forward folded part of the connector clip comprises an inclined plane.

Preferably, the inclined plane is part of the compressive flange 65, 75, 85, such as part of the front side of the compressive flange. Thus, advantageously, the compressive flange comprises a V-shaped profile or skew V-shaped profile, as seen in cross section. Preferably, the V-shaped profile is skewed towards the lamella groove, or the front side of the clip, as most clearly seen in FIG. 15. This has the advantage of facilitating a sliding installation into the lamella groove, and a more robust and stable attachment to the lamella groove. In a preferred embodiment, the skew V-shaped profile is configured such that the lamella is fixedly attached, meaning that a subsequent detachment of the lamella will cause the V-shaped profile to be distorted, such that the profile is suitable for only one-time lamella attachment.

In a further embodiment of the disclosure, the at least two forward folded parts comprises a compressive flange configured to be pressed towards each other upon slidingly forced attachment to the lamella groove. In a further embodiment, the compressive flange has a V-shaped profile, or a skew V-shaped profile. In a further embodiment, the V-shaped profile is skewed towards the lamella groove.

The connector clip may advantageously be manufactured from a single piece of steel sheet, which is cut and bend into a three-dimensional shape. Hence, the connector clip may be manufactured in a simple and cost-efficient way, and without the requirement of additional connector parts for performing the installation. Additionally, the installation may be carried out first by attaching the connector clip gripping flange to the supporting profile, and then attaching the lamella to the connector clip compressive flange 65, 75, 85 where both steps may be done by use of manual force and without additional tools.

Figure 8:
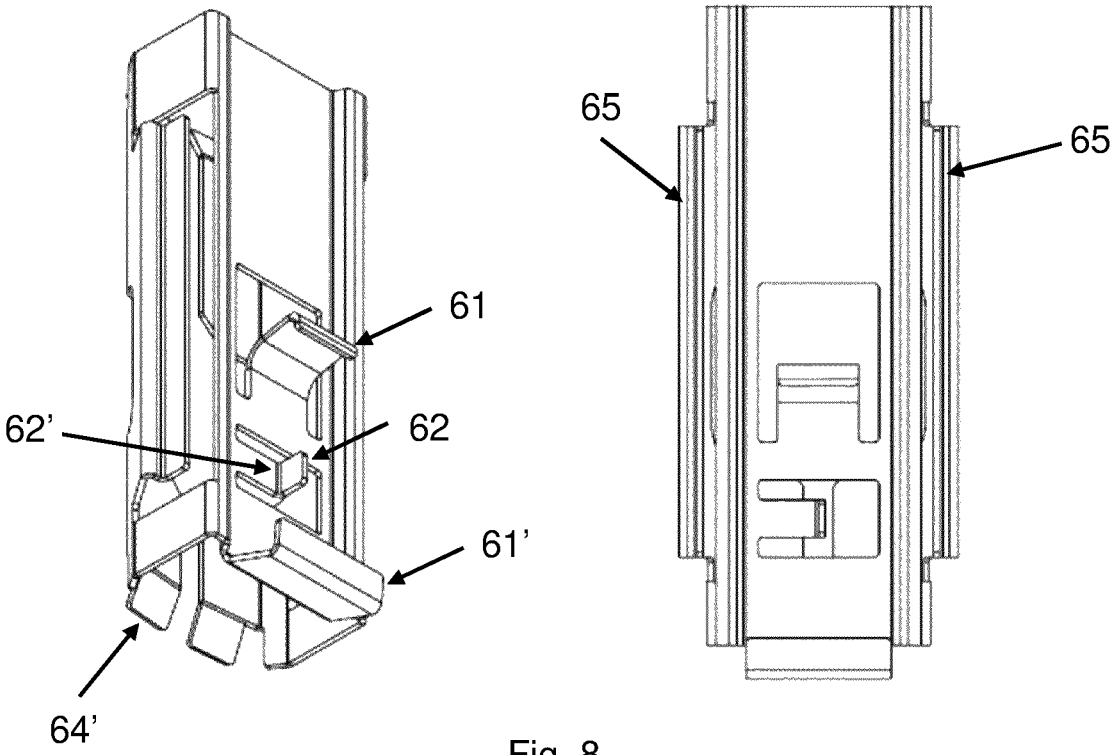
FIG. 8 shows an embodiment of the connector clip according to the present disclosure as seen from the rear side in perspective view to the left and rear side view to the right.
Figure 9:
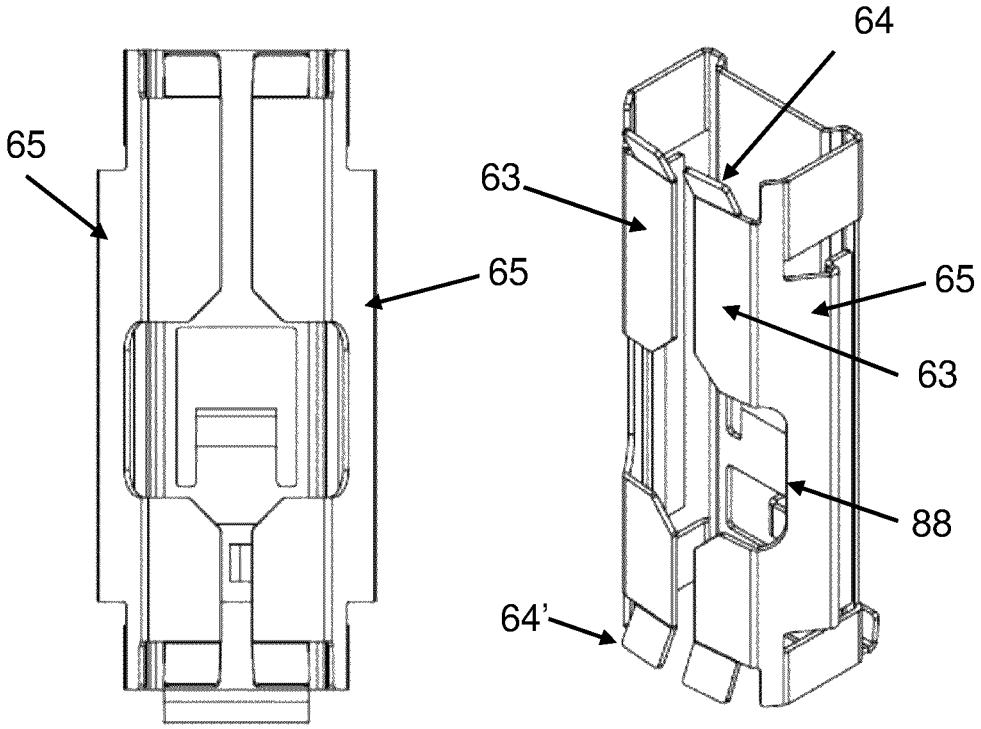
FIG. 9 shows the embodiment in FIG. 8 of the connector clip according to the present disclosure as seen from the front side in front side view to the left and perspective view to the right.
Figure 10:
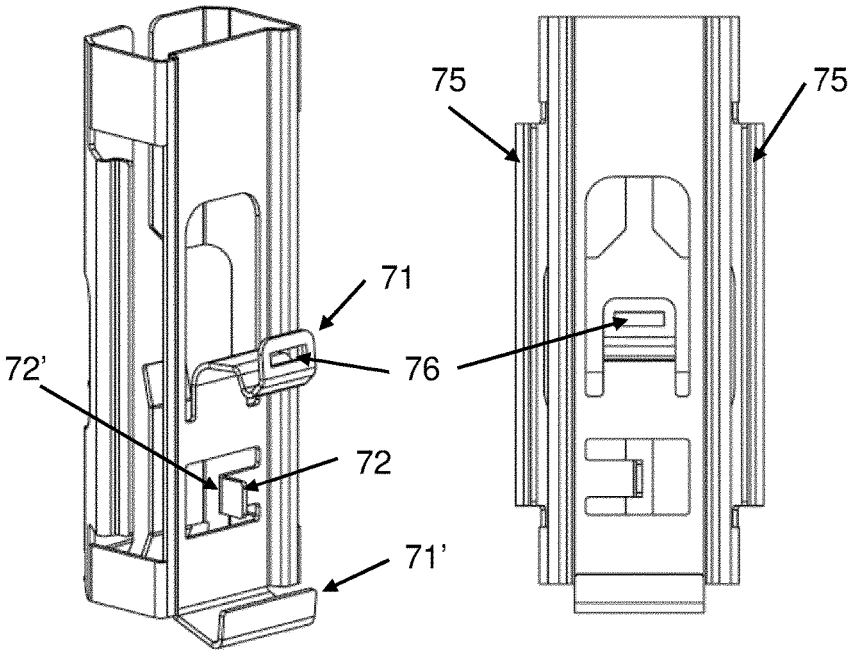
FIG. 10 shows a preferred embodiment of the connector clip according to the present disclosure as seen from the rear side in perspective view to the left and rear side view to the right.
Figure 11:
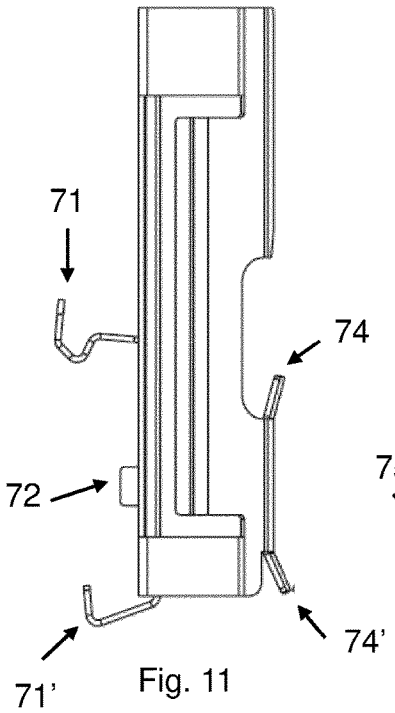
FIG. 11 shows the embodiment in FIG. 10 of the connector clip according to the present disclosure as seen from the side.
Figure 12:
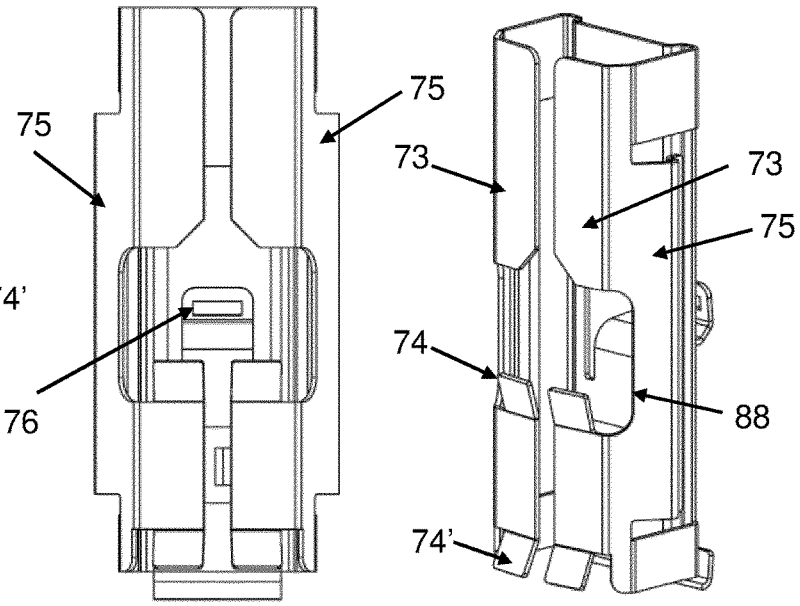
FIG. 12 shows the embodiment in FIGS. 10 and 11 of the connector clip according to the present disclosure as seen from the front side in front side view to the left and perspective view to the right.
Figure 13:
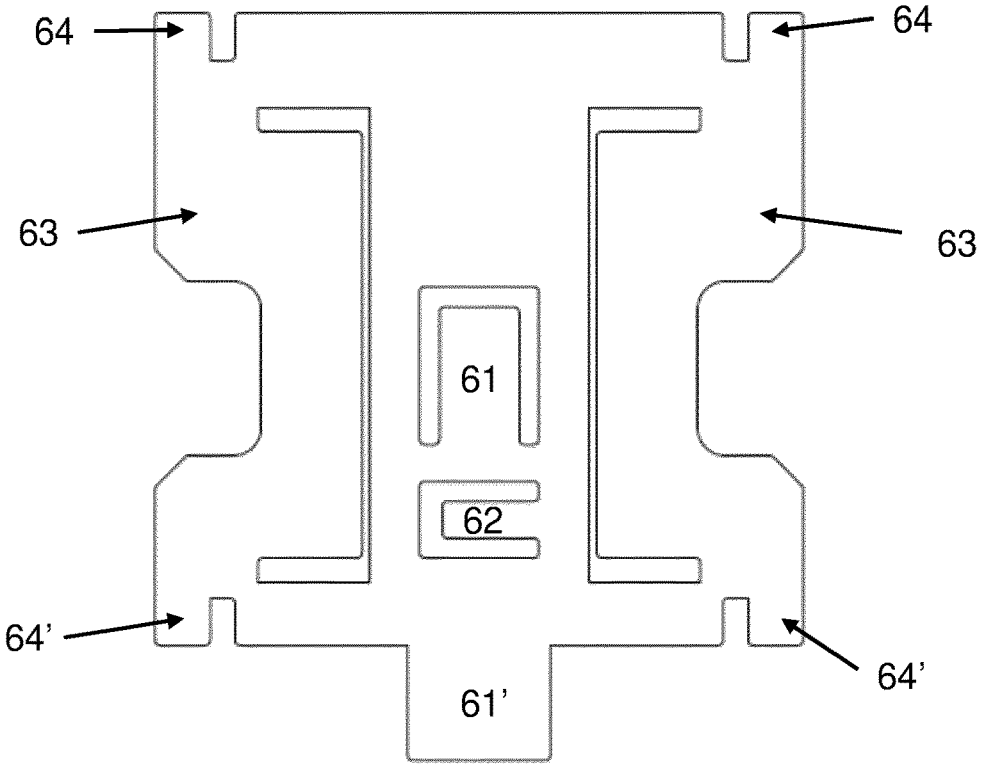
FIG. 13 shows an embodiment of a cut steel sheet for manufacturing the connector clip as seen in FIGS. 8-9.
Figure 14:
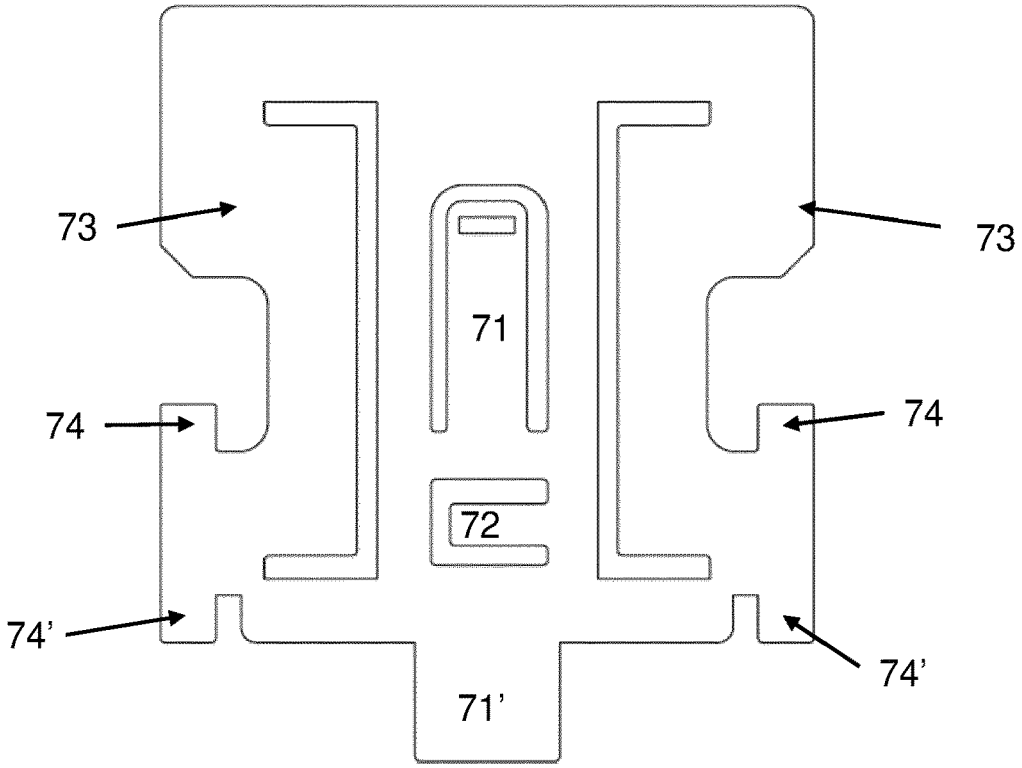
FIG. 14 shows an embodiment of a cut steel sheet for manufacturing the connector clip as seen in FIGS. 10-12.

FIGS. 13 and 14 show embodiments of a cut steel sheet before it is bend into a three-dimensional shape, and FIGS. 8-9 and 10-12 show embodiments of the connector clip after cutting and bending, the cut steel sheet shown in FIG. 13 being bend into the connector clip shown in FIGS. 8-9, and the cut steel sheet shown in FIG. 14 being bend into the connector clip shown in FIGS. 10-12. The connector clip comprises a planar, longitudinal part for abutting the front flange 4*a* of the supporting profile 4, which is the central part of the sheets shown in FIGS. 13 and 14 and which is not bend. The connector clip further comprises two rearward folded parts, shaped by bending the sections indicated as 61, 61', 71, 71' in FIGS. 13 and 14 towards a first side, i.e. the rear side, of the clip. The rearward folded parts are bend such that the sections form a gripping flange or gripping finger, for detachable attachment to the supporting profile. The connector clip further comprises two forward folded parts 63, 73, shaped by bending the sections indicated as 63, 74 in FIGS. 13 and 14 towards a second side, i.e. the front side, of the clip. The forward folded parts are bend such that the sections form a compressive flange 65, 75 for forming a detachably spring force attachment to the lamella.

An aspect of the disclosure relates to a connector clip for a lamella fixing system and suitable for interconnecting a lamella and a supporting profile, comprising a steel sheet comprising a planar, longitudinal part, at least one rearward folded part for attachment to a supporting profile, and at least one forward folded part for attachment to a groove within a lamella, wherein the least one forward folded part is configured to be elastically compressed in the width direction, thereby forming an elastically stressed configuration.

For stable and reliable installation of the connector clip to a supporting profile and a lamella, the connector clip advantageously has certain dimensions. Advantageously, the length of the planar part is between 2-8 cm, more preferably between 3-6 cm, such as 4 cm. Further advantageously, the width of the planar part is between 0.5-3 cm, more preferably between 0.8-2 cm, such as 1 cm. Further advantageously, the forward folded part extend between 5-20 mm in the depth direction, i.e. the direction perpendicular to the planar, longitudinal part, more preferably between 7-15 mm, and most preferably between 8-12 mm, such as 10 mm.

To obtain an efficient spring force connection, and ensure stable and efficient attachment to the supporting profile, as well as stable and efficient attachment to the lamella groove, the connector clip is advantageously made of a steel sheet, and preferably is made of spring steel sheet. Spring steel sheet has the advantage of being particularly elastically compressive, i.e. the shape of a folded sheet may be compressed, e.g. further folded, to an elastically stressed configuration, and the elastic forces will act as a spring force to recoil or unfold towards the non-stressed configuration. In addition to the steel material, the elastic spring force will depend on the sheet thickness. If the thickness is too large, the flexibility is reduced, and if the thickness is too small, the folded sheet becomes mechanically unstable and may kink or break. Sufficient strength and elastic spring forces are efficiently obtained for steel sheet thickness of between 0.2-1.8 mm.

In an embodiment of the disclosure, the steel sheet is a spring steel sheet. In a further embodiment of the disclosure, the thickness of the steel sheet is between 0.2-1.8 mm, more preferably between 0.3-1.5 mm, and most preferably between 0.3-1 mm, such as 0.4, 0.5 or 0.7 mm.

The connector clip according to the present disclosure is suitable for, and advantageously configured for the lamella fixing system according to the present disclosure.

Connector Clip Front Side

Figure 7:
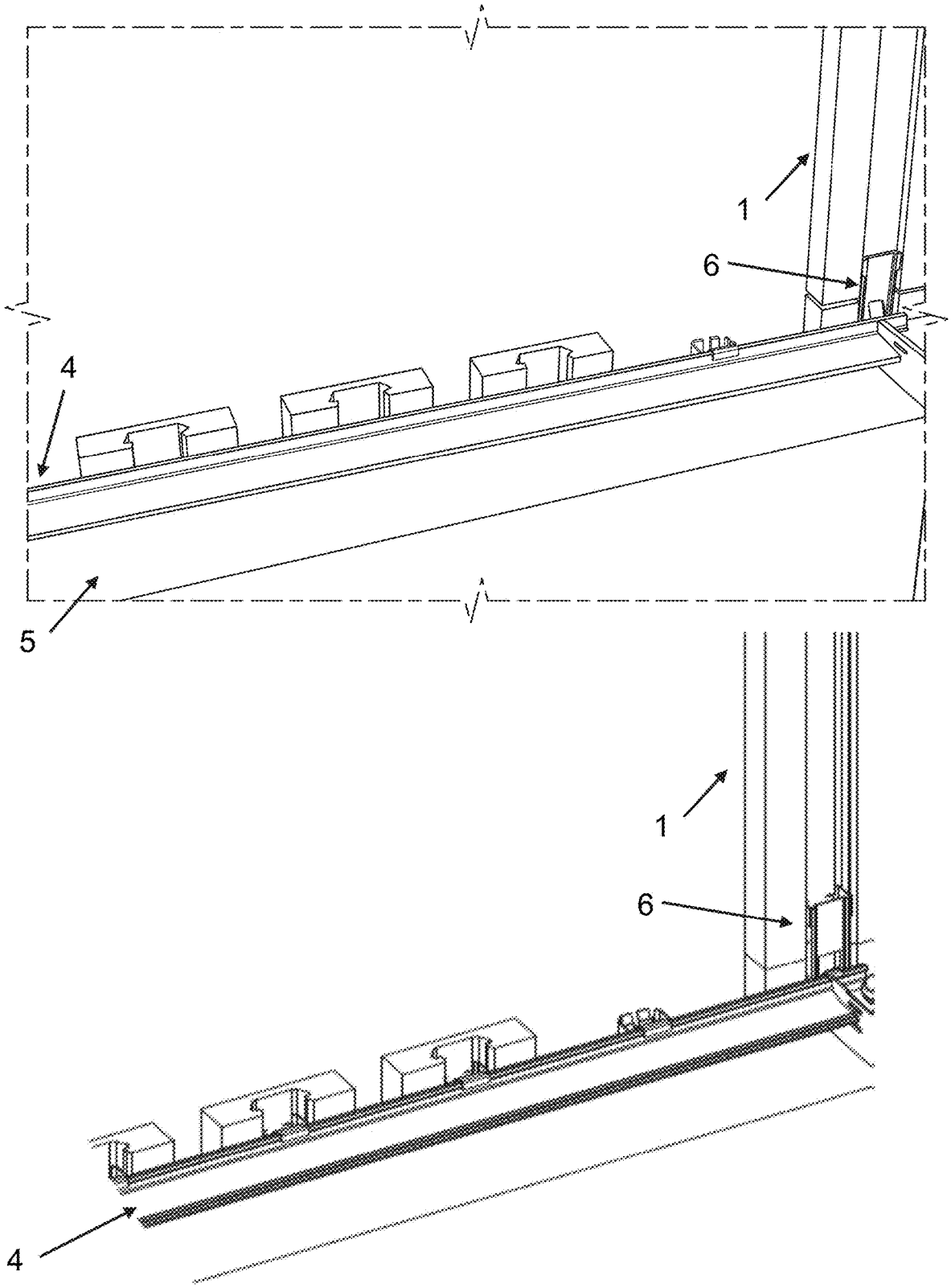
FIG. 7 shows an embodiment of the connector clip according to the present disclosure, attached to a supporting profile and two lamellae, as viewed from the rear side of the wall, in perspective view (upper figure), and line drawing (lower figure)

The front side of the clip engages with the lamella groove via the at least one forward folded part, configured to be elastically compressed in the width direction, as described above. For further simple and easy installation, the clip preferably comprises two forward folded parts as shown in FIGS. 6 and 8-12 and 15. To further ensure stable and mechanical robust installation, the forward folded part(s) are configured to form a snap-fit attachment to the lamella. This may e.g. be obtained by the at least one or two forward folded parts 63, 64, 64', 74, 74, 74', 83, wherein the folded section is folded such that it partially extends perpendicular to the planar, longitudinal part, and/or by a lamella with an undercut groove on the rear side that essentially fits onto the clip, as illustrated in FIG. 7. Hence, the clip deforms and snap/click into the groove, when the lamella is forced against the clip.

In an embodiment of the disclosure, the connector clip comprises at least two forward folded parts configured to be pressed towards each other upon slidingly attachment to the lamella groove.

In another and further embodiment of the disclosure, the at least one forward folded part is configured to form a snap-fit attachment to the lamella groove.

In another and further embodiment of the disclosure, the lamella comprises an undercut groove.

For simple and flexible manufacture, the connector clip advantageously comprises symmetrical parts/sections and/or as few edges as possible. Hence, the two forward folded parts are advantageously symmetrical, and with similar dimensions as the planar, longitudinal part, as seen from the front side. Alternatively, the two forward folded parts have different lengths, and/or have different dimensions as the planar, longitudinal part, which may further improve the fixation of the lamella.

In an embodiment of the disclosure, the at least two forward folded parts are symmetrically positioned around the planar, longitudinal part. In a further embodiment, the at least two forward folded parts are placed centrally to the length of the planar, longitudinal part. In a further embodiment, the at least two forward folded parts have essentially the same length or a different length as the planar, longitudinal part.

To further ensure stable and mechanical robust installation and fixation of the lamella, the connector clip advantageously comprises at least one further or third and further forward folded part. FIGS. 9, 11, and 12 shows an embodiment of the further or third further forward folded part 64, 64', 74, 74'. The further forward folded part may form a barbed engagement to the lamella groove, such as the rear surface of the lamella groove, thereby further increasing the attachment stability. Advantageously, the connector clip comprises four third and further forward folded parts 64, 64', 74, 74', as shown in FIGS. 8-12, such that the connector clip is mirror symmetrical, as seen from the front side, apart from the rearward flap 62, 72.

In an embodiment of the disclosure, the connector clip comprises at least one further or third, further forward folded part configured to form a barbed engagement to the lamella groove. In a further embodiment, the connector clip comprises two or more third, further forward folded parts, preferably comprises four third, further forward folded parts, which are optionally symmetrically placed.

As seen in the embodiment of the connector clip in FIGS. 8 and 9, the four third and further forward folded parts 64, 64' are located at the top and bottom edges of the clip. In the preferred embodiment of the connector clip shown in FIGS. 10-12 further forward folded parts 74' are still located at the bottom edge of the clip, whereas the remaining further folded parts 74 are located around the middle part of the clip. In that regard the position along the longitudinal direction of the clip of the further forward folded parts 74, 74' thereby substantially match the position of the rearward folded parts 71, 71'—this is most clearly seen in the side view in FIG. 11. This provides improved stability to the presently disclosed lamella system because the attachment points between the connector clip and the supporting profile on the rearward side of the connector clip will then match the stability points between the connector and a lamella element on the forward side of the connector clip.

Alternatively, or additionally, the further or third, further forward folded part 87 forms a barbed engagement to an edge surface of the lamella groove, as shown in FIG. 15. Similar to the further forward folded parts 64, 64', 74, 74' which form a barbed engagement to the rear surface of the lamella groove, as shown in FIGS. 9 and 12, the barbed engagement to the groove edge increases the attachment stability, and e.g. fixes the clip within the groove, and impedes movement of the clip along the groove. Particularly stable fixation may be obtained for a system comprising two further forward folded parts 87 forming a barbed engagement to both edge surfaces of the lamella groove, as shown in FIG. 15.

In an embodiment of the disclosure, the at least one forward folded part comprises a further folded part configured to form a barbed engagement to the lamella groove. In a further embodiment, the system comprises two or more further or third, further forward folded parts, preferably two further forward folded parts. In a further embodiment, the further folded part forms a barbed engagement to one or more edge surface(s) of the lamella groove, and/or a rear surface of the lamella groove.

The connector clip front side may further comprise an aperture 88 positioned such that one or more of the rearward folded parts are visible through the aperture, when the connector clip is viewed from the front side. Hence, the attachment of the at least one rearward folded part to the supporting profile may be controlled and/or monitored through the aperture. Advantageously, a further rearward folded part 62, 72, 82 configured to engage with a feature of the supporting profile, such as a depression or a slit of the supporting profile front flange 4*a*, is visible through the aperture. This may be obtained via rectangular aperture, as shown in FIGS. 9 and 12, or a circular aperture, as shown in FIG. 15.

In an embodiment of the disclosure, the at least one forward folded part comprises an aperture positioned such that the further rearward folded part configured to engage with a depression of the supporting profile, is visible through the aperture. In a further embodiment the aperture is rectangular or circular, In an embodiment of the disclosure, the front flange of the supporting profile comprises a depression or a slit, configured to engage with a further rearward folded part.

Connector Clip Rear Side

For stable and mechanical robust installation and fixation of the connector clip to the supporting profile, the connector clip rear side advantageously comprises two rearward folded parts 61, 61', 71, 71', 81, 81'. Hence, the rearward folded parts 61, 61', 71, 71', 81. 81' may form two gripping flanges, or gripping fingers, that extend backwards and are configured to click around the upper and lower edges of the front flange of the supporting profile, as indicated in FIGS. 8, 10 and 11 and 15. Further advantageously, the rearward folded parts 61, 61', 71, 71', 81, 81' are configured to form a snap-fit attachment to the supporting profile, e.g. by the at least two rearward folded parts 61, 61', 71, 71', 81, 81' being folded such that they form opposing hooks. Hence, the two rearward folded parts comprises an upper rearward folded part 61, 71, 81, and a lower rearward folded part 61', 71', 81'. Hence, the connector clip deforms and snap-fits around the front flange of the supporting profile, when the clip is forced against the supporting profile.

In an embodiment of the disclosure, the connector clip comprises at least two rearward folded parts, such as an upper rearward folded part and a lower rearward folded part. In a further embodiment, the at least two rearward folded parts are configured to form a detachable snap-fit attachment to the supporting profile.

As seen in the embodiment of the connector clip in FIGS. 8 and 9 and 15, the at least two rearward folded parts 61, 61' are being folded such that they form opposing hooks. This is also the case in the preferred embodiment of the connector clip shown in FIGS. 10-12, i.e. the at least two rearward folded parts 71, 71' are being folded such that they form opposing hooks, and FIG. 15 with the parts 81, 81'. However, as also seen in FIGS. 10 and 11 and 15 the upper rearward folded part 71, 81 is provided with at least one additional fold such that the rearward folded part 71, 81 both points downwards toward the lower rearward folded part 71', 81', but ends up with pointing upwards. Hence, at least one of the two rearward folded parts 71, 71', 81, 81' may comprise at least two folds, preferably two folds in the form of a concave fold and a convex fold. The two folds may provide more flexibility to the connector clip which can make attachment to the supporting profile easier. The terms "upper" and "lower" and "top" and "bottom" as used herein typically refer to the orientation shown in the present drawings. As also explained elsewhere the elements of the presently disclosed system can have any orientation in practical use.

The upwards fold(s) does not influence the strength of the snap-fit attachment to the supporting profile, but it makes it easier to disassemble the connector clip from the supporting profile, because the upwards end fold(s) of the upper rearward folding part 71, 81 makes it easier to grab the part 71, 81 with a finger. As also seen in FIGS. 10 and 12 and 15 the upper folded part 71, 81 can also be provided with a hole 76 in the sheet, alternatively just a notch or indentation in the sheet, whereby an elongated tool or the like, such as a screwdriver, can be inserted from a front side of the connector clip, through the connector clip and into the hole 76 of the upper rearward folded part 71 such that the tool can lift the rearward part 71, whereby the connector clip can be disassembled from the front side of the connector clip, as illustrated in FIG. 16. Hence, at least one of the two rearward folded parts may comprise a hole or notch or indentation configured such that the snap-fit attachment to the supporting profile can be disassembled by engaging said hole or notch or indentation with a protrusion tool viaa front side of the connector clip.

For simple and flexible manufacture, the connector clip advantageously comprises symmetrical parts/sections and/or as few edges as possible. Hence, the two rearward folded parts are advantageously symmetrically positioned relative to the planar, longitudinal part, as seen from the rear side, e.g. placed symmetric relative to the longitudinal centre-line or the transverse centre-line of the planar, longitudinal part. Hence, two rearward folded parts positioned with the same distance to the longitudinal centre-line, are centrally positioned relative to the length. For example, the two rearward folded parts 81' may extend from the opposite edges of the planar, longitudinal part, as shown in FIGS. 15-16.

In an embodiment of the disclosure, the at least two rearward folded parts are symmetrically positioned relative to the longitudinal centre-line of the planar, longitudinal part. In a further embodiment, the at least two rearward folded parts extend from an edge of the planar, longitudinal part.

Alternatively, the at least two rearward folded parts are placed non-centrally to the length of the planar, longitudinal part, i.e. the two parts are placed at different distances to the centre-line of the longitudinal part, as illustrated in FIGS. 6 and 8-12. For example as shown in FIGS. 6 and 8-12, the at least one rearward folded part 61', 71' extends from an edge of the planar, longitudinal part, while the second rearward folded part 61, 71 extends from a central area of the planar longitudinal part, i.e. in the vicinity of the centre-line of the longitudinal part. This facilitates that the clip can be mounted on the supporting profile in two directions. This is possible since the gripping flanges or fingers on the rear side are arranged at the end of the clip and not centrally. In this way the same clip can be used in three situations: at an edge of the system with the finger end downwards (as shown in FIG. 6, the clip to the left), at an edge of the system with the finger end upwards (cf. FIG. 6, the clip to the right), at intermediate supporting profiles in either suitable direction (upwards and downwards) where two lamellae face each other end-to-end, as shown in FIG. 7. Further advantageously, the clip may be used in the middle of a lamella. In this fourth situation, any orientation of the fingers may be applied depending on the surroundings. For example, the clip may be positioned in the middle of a lamella and at edges around power outlets, signs, or other parts that are integrated into the lamella wall.

In an embodiment of the disclosure, the at least two rearward folded parts are non-symmetrically positioned relative to the longitudinal centre-line of the planar, longitudinal part. In a further embodiment, the at least one rearward folded parts extends from an edge of the planar, longitudinal part.

The at least two rearward folded parts advantageously have different widths. For example, the lower rearward folded part 61', 71' extending from the lower edge of the longitudinal part is advantageously wider than the upper rearward folded part 61, 71 extending from the central area, as shown in FIGS. 8 and 10. The different widths facilitate that the wider part 61', 71' may be hooked or attached onto the front flange of the supporting profile first, and then the less wide part 61, 71 may be pressed onto the opposing side of the front flange of the supporting profile. Thus, the connector clip may be mounted onto the supporting profile by use of manual force. To further facilitate manual attachment of the clip to the supporting profile front flange, the rearward folded part extending from an edge of the planar, longitudinal part is advantageously wider than the rearward folded part extending from a central area.

In an embodiment of the disclosure, the at least two rearward folded parts have different widths. In a further embodiment, the rearward folded part extending from an edge of the planar, longitudinal part is wider than the rearward folded part extending from a central area.

The front flange **4*a* of the supporting profile may be provided with regularly spaced depressions or openings or slits 4*c*, as illustrated in FIGS. 5, 16 and 17. Preferably, the depressions or openings are linear slits, which may be oriented perpendicular to the longitudinal supporting profile, as shown in FIG. 5, or oriented parallel to the longitudinal supporting profile, as shown in FIGS. 16-17**.

The rear side of the clip may further be provided with at least one further rearward folded part 62, 72, 82, such as a third rearward folded part 62, 72, 82 e.g. in the form of a tongue, that fits into the slit **4*c*. This facilitates that the distance between neighbouring clips and lamellae becomes identical. For example, the slits may be pre-positioned at a distance of preferably 60 mm, such that when neighbouring clips are inserted into the slits, the distance between the clips are identical. Advantageously, the further rearward folded part is engaging with a slit or depression within the supporting profile, preferably provided in the front flange 4*a*** of the supporting profile.

In an embodiment of the disclosure, the front flange comprises a depression or a slit, configured to engage with the at least one further rearward folded part with a spring function.

The tongue 62, 72, 82 of the clip may advantageously have a spring function, so that the clip may still be mounted on the supporting profile even though it is not aligned with a slit. Thus, the third rearward folded part 62, 72, 82 may be configured as a spring biased mechanism, which form a barbed engagement to the supporting profile when it is not aligned with a slit. Hence, the further or third rearward folded part may form a spring connection to the supporting profile, and the third rearward folded part thus have two configurations: a first configuration, where the rearward folded part is folded as-manufactured, and essentially non-stressed, and a second less folded configuration, where the rearward folded part is compressed against the supporting profile to be stressed as a spring. Hence, the first folded configuration, where the tongue is aligned and engages with the slit may also be referred to as a latched position or configuration. The second configuration, where the tongue is not aligned with a slit and instead is compressed into a less folded configuration, may also be referred to as a primed position or configuration.

This further improves the flexibility of the installation, because the attachment of the lamellae are not restricted by the distance between the depressions or slits of the supporting profile. Hence, lamella walls with variable distance between the lamella are easily installed. Further, the spring function of the further rearward folded part further improves the attachment stability of the clip to the supporting profile, due to the barbed engagement obtained when the tongue is compressed against the supporting profile at a position, where it is not engaging with a depression, such as a slit. When the tongue is engaging with a depression or a slit, the spring force of the tongue is released or partly released.

In an embodiment of the disclosure, the connector clip comprises at least one further rearward folded part folded such that it has spring function and is further configured to engage with a depression of the supporting profile.

In an embodiment of the disclosure, the connector clip comprises a further or third rearward folded part for engagement with the supporting profile. In a further embodiment, the third rearward folded part is configured to form a barbed engagement to the supporting profile, and/or is configured to engage with an opening, such as a slit, of the supporting profile.

The further or third rearward folded part 62, 72, 82 are advantageously positioned between an upper rearward folded part 61, 71, 81, and a lower rearward folded part 61', 71', 81'. Hence, it may also be referred to as a middle rearward folded part, with a spring function and which is configured for engagement with a depression of the supporting profile.

In an embodiment of the disclosure, the further rearward folded part has a spring function between a folded and less folded configuration, and optionally the further rearward folded part with spring function comprises at least one middle or third rearward folded part configured for engagement with the depression or slit of the supporting profile. In a further embodiment, the middle rearward folded part is configured to form a barbed engagement to the supporting profile, and/or configured to engage with an opening, such as a slit, of the supporting profile.

The spring function of the further rearward folded part, or the third or middle rearward folded part, is activated, when the tongue is compressed against the supporting profile at a position, where it is not engaging with a depression or slit. Advantageously, the spring function is obtained by the rearward folded configuration as obtained from the manufactured folding. For example, the further rearward folded part may comprise a linear hinge zone 62', 72', 82' or folding line. The folding line may be vertically oriented 62', 72', as shown in FIGS. 8 and 10. Alternatively, or additionally, the further rearward folded part may be horizontally oriented 82', as shown in FIG. 15. The folding line thus facilitates that the manufactured folded part is subjected to a spring force, by being reversed to the unfolded or primed pre-folded configuration, when the tongue is compressed against the supporting profile at a position, where it is not engaging with a depression or slit. To adjust the spring force of the further folded part, the hinge zone may comprise one or more strip-shaped elements, similar to a hinge, as shown in FIG. 15.

In an embodiment of the disclosure, the further rearward folded part with spring function, comprises a hinged zone, such that the fold has spring function or is reversibly folded. In a further embodiment, the hinged zone is horizontally and/or vertically oriented relative to the planar, longitudinal part of the clip. In a further embodiment, the hinged zone comprises one or more strip-shaped elements.

To improve the stability of the clip attachment to the supporting profile, and particular reduce the risk of the clip being moved along the supporting profile, i.e. translated in the length direction of the supporting profile, the connecting clip advantageously comprises an additionally rearward folded part, which preferably is located to be a second middle rearward folded part 86, as shown in FIG. 15. The second rearward folded part advantageously comprises at least two legs or planes, oriented at an angle and with opposite slopes, such that the planes form a V-shape. The opposite slopes form opposite barbed engagement to the supporting profile, and hence reduce the risk of the clip being translated in any direction along the supporting profile.

In an embodiment of the disclosure, the system comprises a second middle rearward folded part configured to form a barbed engagement to the supporting profile. In a further embodiment, the second middle rearward folded part comprises two planes at an angle, optionally forming a V-shape.

Installation

The connector clip and lamella fixation system according to the present disclosure provide a cost-efficient installation without the requirement of additional connector parts, apart from the connector clip itself, or additional tools, and which advantageously are carried out by manual force. The fixation system is further compatible with auxiliary wall components, such as wall profiles 3 as shown in FIG. 1, and outer frames 7 as shown in FIGS. 5-7. Alternatively, the fixation system may be installed without the used of wall profiles, i.e. the supporting profiles are mounted directly on the wall. In an embodiment of the disclosure, the fixation system comprises wall profiles.

Advantageously, the fixation system is provided as a kit of parts, and installed on-site. Further advantageously, the installed fixation system may be dismounted or dismantled without additional parts or additional tools, and by manual force. In addition or alternatively, the fixation system may be dismounted using one or more additional tools, e.g. a tool for dismounting the clip from the supporting profile. The tool may be configured such that the shape of the clip is easily maintained and/or restored upon dismounting.

An aspect of the disclosure relates to a method of installing a lamella, comprising the steps of:

(a) providing a lamella fixing system comprising at least a supporting profile, a lamella comprising a groove, and a connector clip comprising a steel sheet, comprising a planar, longitudinal part, at least one rearward folded part, and at least one forward folded part, (b) attaching the rearward folded part of the connector clip to the supporting profile, (c) slidingly attaching the lamella groove to the forward folded part of the connector clip by elastically compressing the forward folded part in a direction perpendicular to the longitudinal direction.

A further aspect of the disclosure relates to a kit of parts for a lamella wall, comprising: one or more supporting profiles, one or more lamellae, one or more connector clips, and optionally one or more wall profiles, wherein the parts are configured for installation according to the aspect above.

REFERENCE NUMBERS

1—Lamella
2—Supporting wall
3—Wall profiles
4—Supporting profile
4*a*—Front flange
4*b*—Rearward flange
4*c*—Opening or slit or depression
5—Acoustic panel
6—Connector clip
7—Frame
61, 71, 81—Upper rearward folded part
61', 71', 81'—Lower rearward folded parts
62, 72, 82—First middle rearward folded part
62', 72', 82'—Hinged zone
86—Second middle rearward folded part
63, 73, 83—First and second forward folded part
87—Further or third folded part of the forward folded part
64, 74—Upper further forward folded parts
64', 74'—Lower further forward folded parts
65, 75, 85—Compressive flange
76—Hole in upper rearward folded part
88—Aperture

REFERENCES

[1] AU2018282353

Items

The presently disclosed invention may be described in further detail with reference to the following items.

1. A lamella fixing system, comprising:
   at least one supporting profile (4),
   at least one lamella (1) comprising a groove, and
   at least one connector clip (6) for interconnecting the lamella and the supporting profile,
   wherein the connector clip is made of a steel sheet comprising a planar, longitudinal part, at least one rearward folded part (61,71,81,61',71',81') for attachment to the supporting profile, and at least one forward folded part (63,73,83) for attachment to the lamella groove.
2. The system according to item 1, wherein the steel sheet comprises spring steel or consists of spring steel.
3. The system according to any of the preceding items, wherein the thickness of the steel sheet is between 0.2-1.8 mm, more preferably between 0.3-1.5 mm, and most preferably between 0.3-1 mm, such as 0.4, 0.5 or 0.7 mm.
4. The system according to any of the preceding items, wherein the at least one forward folded part (63,73,83) is configured to be elastically compressed in the width direction, thereby forming an elastically stressed configuration.
5. The system according to any of the preceding items, comprising at least two forward folded parts.
6. The system according to item 5, wherein the at least two forward folded parts are configured to be pressed towards each other upon slidingly forced attachment to the lamella groove.
7. The system according to any of the preceding items, wherein the at least one forward folded part is configured to form a snap-fit attachment to the lamella groove.
8. The system according to any of items 5-7, wherein the at least two forward folded parts are symmetrically positioned around the planar, longitudinal part.
9. The system according to any of items 5-8, wherein the at least two forward folded parts are placed centrally to the length of the planar, longitudinal part.
10. The system according to any of items 5-9, wherein the at least two forward folded parts are configured such that a folded portion is abutting each other.
11. The system according to any of items 5-10, wherein the at least two forward folded parts comprises a compressive flange (65,75,85) configured to be pressed towards each other upon slidingly forced attachment to the lamella groove.
12. The system according to item 11, wherein the compressive flange (65,75,85) has a V-shaped profile, or a skew V-shaped profile.
13. The system according to item 12, wherein the V-shaped profile is skewed towards the lamella groove.
14. The system according to any of the preceding items, wherein the at least one forward folded part comprises an aperture (88) positioned such that the further rearward folded part (62,72,82) configured to engage with a depression of the supporting profile, is visible through the aperture.
15. The system according to item 14, wherein the aperture is rectangular or circular.
16. The system according to any of the preceding item, wherein the at least one forward folded part comprises a further folded part (87) configured to form a barbed engagement to the lamella groove.
17. The system according to any of the preceding items, further comprising at least one third, further forward folded part (87,64,74,64',74') configured to form a barbed engagement to the lamella groove.
18. The system according to item 17 comprising two or more third, further forward folded parts (87), preferably comprising two or four third, further forward folded parts (64,74,64',74'), which are optionally symmetrically placed.
19. The system according to any of items 16-18, wherein the further folded part (87) forms a barbed engagement to one or more edge surface(s) of the lamella groove, and/or a rear surface of the lamella groove.
20. The system according to any of the preceding items, comprising at least two rearward folded parts (61,71, 81,61',71',81'), such as an upper rearward folded part (61,71,81) and a lower rearward folded part (61',71', 81').
21. The system according to item 20, wherein the at least two rearward folded parts for attachment to the supporting profile are configured to form a detachable snap-fit attachment to the supporting profile.
22. The system according to any of items 20-21, wherein the at least two rearward folded parts are placed symmetrically or non-symmetrically relative to the longitudinal centre-line of the planar, longitudinal part.

23. The system according to any of the preceding items, wherein the at least one rearward folded parts (61',71', 81') extend from an edge of the planar, longitudinal part.
24. The system according to any of items 20-23, wherein the at least two rearward folded parts extend from an edge of the planar, longitudinal part.
25. The system according to any of items 20-24, wherein the at least two rearward folded parts have different widths, preferably wherein the at least one rearward folded part extending from an edge of the planar, longitudinal part is wider than a rearward folded part extending from a central area.
26. The system according to any of items 20-24, wherein at least one of the two rearward folded parts (71,81) comprises at least two folds, preferably two folds in the form of a concave fold and a convex fold.
27. The system according to any of items 20-25, wherein at least one of the two rearward folded parts comprises a hole or notch or indentation (76) configured such that the snap-fit attachment to the supporting profile can be disassembled by engaging said hole or notch or indentation via a protrusion of a tool, such as a front side of a connector clip.
28. The system according to any of the preceding items, wherein the further rearward folded part (62,72,82) has a spring function between a folded and less folded configuration, and optionally the further rearward folded part with a spring function comprises at least one middle or third rearward folded part configured for engagement with the depression of the supporting profile.
29. The system according to item 28, wherein the at least one middle or third rearward folded part is configured to form a barbed engagement to the supporting profile, and/or configured to engage with an opening, such as a slit, of the supporting profile.
30. The system according to any of the preceding items, wherein the further rearward folded part with spring function, comprises a hinged zone (82'), such that the fold has spring function or is reversibly folded.
31. The system according to item 30, wherein the hinged zone is horizontally and/or vertically oriented relative to the planar, longitudinal part of the clip.
32. The system according to any of items 30-31, wherein the hinged zone comprises one or more strip-shaped elements.
33. The system according to any of items 28-32, comprising a second middle rearward folded part (86) configured to form a barbed engagement to the supporting profile.
34. The system according to item 33, wherein the second middle rearward folded part (86) comprises two planes at an angle, optionally forming a V-shape.
35. The system according to any of the preceding items, wherein the at least one lamella comprises an undercut groove.
36. The system according to any of the preceding items, wherein the supporting profile comprises a front flange (4*a*) in parallel to the wall surface, and at least one fastening element for attachment to a supporting wall (2).
37. The system according to item 36, wherein the fastening element comprises a rearward flange extending perpendicular to the front flange, such that the supporting profile is T-shaped or asymmetric T-shaped in cross-section.
38. The system according to any of items 36-37, wherein the supporting profile comprises a rear flange in parallel with the front flange, such that the supporting profile is H-shaped or U-shaped in cross-section.
39. The system according to any of items 36-37, wherein the front flange (4*a*) comprises the depression, such as a slit, configured to engage with the at least one further rearward folded (62,72,82) with spring function.
40. A method of installing a lamella, comprising the steps of:
    (a) providing a lamella fixing system comprising at least a supporting profile (4), a lamella (1) comprising a groove, and a connector clip (6) made of a steel sheet, comprising a planar, longitudinal part, at least one rearward folded part, and at least one forward folded part,
    (b) attaching the rearward folded part of the connector clip to the supporting profile,
    (c) slidingly attaching the lamella groove to the forward folded part of the connector clip by force, thereby elastically compressing the forward folded part in a direction perpendicular to the longitudinal direction.
41. The method according to item 39, comprising the steps of:
    (a) providing a lamella fixing system comprising at least a supporting profile (4), a lamella (1) comprising a groove, and a connector clip (6) made of a steel sheet, comprising a planar, longitudinal part, at least one rearward folded part, at least one further rearward folded part with a spring function between a folded and less folded configuration, and at least one forward folded part,
    (b) attaching the at least one rearward folded part of the connector clip to the supporting profile, whereby the spring function of the at least one further rearward folded part is activated,
    (c) slidingly attaching the lamella groove to the forward folded part of the connector clip by force, thereby elastically compressing the forward folded part in a direction perpendicular to the longitudinal direction.
42. The method according to any of items 39-40, wherein the lamella fixing system is the system according to any of items 1-38.

The invention claimed is:

1. A lamella fixing system for fixing each of a plurality of lamella to a surface of a supporting wall, comprising:

at least one supporting profile, wherein each of the at least one supporting profile comprises a front flange and at least one fastening element for attaching the supporting profile to the supporting wall such that the front flange extends parallel to the surface of the supporting wall;

each of the plurality of lamella comprising a groove; and a plurality of connector clips for interconnecting the plurality of lamella and the at least one supporting profile;

wherein each of the plurality of connector clips is made of a steel sheet, each of the plurality of connector clips comprising:

a planar, longitudinal part;

at least one rearward folded part for attachment to one of the at least one supporting profile; and at least one forward folded part for attachment to the groove of one of the plurality of lamella;

wherein each one of the at least one supporting profile has a plurality of depressions in or openings through the front flange that is parallel to the surface of the supporting wall; and each of the plurality of connector clips has at least one further rearward folded part configured to engage with one of the depressions in or openings through the front flange of the supporting profile to which the connector clip is attached.

2. The lamella fixing system according to claim 1, wherein the steel sheet comprises spring steel.

3. The lamella fixing system according to claim 1, wherein a thickness of the steel sheet is between 0.2-1.8 mm, or between 0.3-1.5 mm, or between 0.3-1 mm, or 0.4, 0.5 or 0.7 mm.

4. The lamella fixing system according to claim 1, wherein the at least one forward folded part is configured to be elastically compressed in a width direction, thereby forming an elastically stressed configuration.

5. The lamella fixing system according to claim 1, wherein the at least one forward folded part comprises at least two forward folded parts.

6. The lamella fixing system according to claim 5, wherein the at least two forward folded parts are configured to be pressed towards each other upon slidingly forced attachment to the groove of the one of the plurality of lamella.

7. The lamella fixing system according to claim 5, wherein the at least two forward folded parts are symmetrically positioned around the planar, longitudinal part, and/or placed centrally to a length of the planar, longitudinal part.

8. The lamella fixing system according to claim 1, wherein the at least one forward folded part is configured to form a snap-fit attachment to the groove of the one of the plurality of lamella.

9. The lamella fixing system according to claim 1, wherein the at least one forward folded part comprises a further or third folded part configured to form a barbed engagement to the groove of the one of the plurality of lamella.

10. The lamella fixing system according to claim 1, wherein the at least one rearward folded part comprises at least two rearward folded parts for attachment to the one of the at least one supporting profile configured to form a detachable snap-fit attachment to the one of the at least one supporting profile.

11. The lamella fixing system according to claim 10, wherein at least one of the two rearward folded parts comprises a hole or notch or indentation configured such that the snap-fit attachment to the one of the at least one supporting profile can be disassembled by engaging said hole or notch or indentation with a protrusion tool via a front side of the connector clip having the at least two rearward folded parts.

12. The lamella fixing system according to claim 1, wherein the at least one rearward folded part extends from an edge of the planar, longitudinal part.

13. The lamella fixing system according to claim 1, wherein the further rearward folded part has a spring function.

14. The lamella fixing system according to claim 1, wherein the groove of each of the plurality of lamella is an undercut groove.

15. The lamella fixing system according to claim 1, wherein the at least one fastening element is a rearward flange extending perpendicular to the front flange or a rear flange in parallel with the front flange, such that each of the at least one supporting profile is T-shaped, H-shaped, U-shaped, or asymmetric T-shaped, H-shaped, U-shaped in cross-section.

16. A method of installing a lamella, comprising:

(a) providing a lamella fixing system according to claim 1;

(b) attaching the rearward folded part of one of the plurality of connector clips to one of the at least one supporting profile; and (c) slidingly attaching the groove of one of the plurality of lamella to the forward folded part of the one of the plurality of connector clips by force, thereby elastically compressing the forward folded part in a direction perpendicular to the longitudinal direction.

17. The lamella fixing system according to claim 1, wherein each of the depressions or openings is a slit.

18. The lamella fixing system according to claim 1, wherein the front flange is spaced from and extends parallel to the surface of the supporting wall.

* * * * *